US008684808B2

(12) United States Patent
Aoki et al.

(10) Patent No.: US 8,684,808 B2
(45) Date of Patent: Apr. 1, 2014

(54) WAGERING GAME WITH OVERLAYING TRANSMISSIVE DISPLAY FOR PROVIDING ENHANCED GAME FEATURES

(75) Inventors: Dion K. Aoki, Henderson, NV (US); John D. Flint, Sharon, MA (US); Philip B. Gelber, Glen Ellyn, IL (US); Benjamin T. Gomez, Chicago, IL (US); Jeremy M. Hornik, Chicago, IL (US); Joel R. Jaffe, Glenview, IL (US); Shridhar P. Joshi, Naperville, IL (US); Larry J. Pacey, Chicago, IL (US); Jamie W. Vann, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 35 days.

(21) Appl. No.: 13/315,583

(22) Filed: Dec. 9, 2011

(65) Prior Publication Data

US 2012/0088567 A1 Apr. 12, 2012

Related U.S. Application Data

(63) Continuation of application No. 12/271,460, filed on Nov. 14, 2008, now abandoned, which is a continuation-in-part of application No. 11/922,455, filed as application No. PCT/US2006/026005 on Jun. 30, 2006, now abandoned.

(60) Provisional application No. 60/695,563, filed on Jun. 30, 2005.

(51) Int. Cl.
*A63F 9/00* (2006.01)

(52) U.S. Cl.
USPC ..... 463/13

(58) Field of Classification Search
None
See application file for complete search history.

(56) References Cited

U.S. PATENT DOCUMENTS

| | | | | |
|---|---|---|---|---|
| 4,306,768 | A | 12/1981 | Egging | 350/174 |
| 4,454,670 | A | 6/1984 | Bachmann et al. | 194/350 |
| 4,517,558 | A | 5/1985 | Davids | 340/700 |

(Continued)

FOREIGN PATENT DOCUMENTS

| | | | |
|---|---|---|---|
| EP | 0 060 019 A1 | 9/1982 | G07F 17/34 |
| EP | 0 789 338 A1 | 8/1997 | G07F 17/32 |

(Continued)

OTHER PUBLICATIONS

"Bigfoot" Product Sheet, Shuffle Master, Inc., 1 page (2000).

(Continued)

*Primary Examiner* — Seng H Lim
(74) *Attorney, Agent, or Firm* — Nixon Peabody LLP

(57) ABSTRACT

A gaming machine for conducting a wagering game includes a game display. A transmissive display is positioned in front of the game display directly in the player's line of sight including game-play regions at which symbols appear and regions above, below, between, and to the sides the game-play regions. The transmissive display is operable to selectively display transparent, translucent and opaque video images over the game display. The transparent, translucent and opaque video images may be used to change, for example, a play mechanic associated with the wagering game and any reel symbols associated with wagering game. The transmissive display may also be used to provide interactive player control and player selection elements for the wagering game and to facilitate player inputs to the gaming machine. The transmissive display may be further used to provide bonus features associated with a bonus game played at the gaming machine.

20 Claims, 15 Drawing Sheets

(56) References Cited

U.S. PATENT DOCUMENTS

| | | | | |
|---|---|---|---|---|
| 4,568,928 | A | 2/1986 | Biferno | 340/716 |
| 4,718,672 | A | 1/1988 | Okada | 273/143 R |
| 5,393,061 | A | 2/1995 | Manship et al. | 273/143 R |
| 5,580,055 | A | 12/1996 | Hagiwara | 273/143 R |
| 5,697,843 | A | 12/1997 | Manship et al. | 463/20 |
| 5,725,210 | A | 3/1998 | Yamaguchi et al. | 273/121 |
| 5,752,881 | A | 5/1998 | Inoue | 273/143 R |
| 5,810,665 | A | 9/1998 | Takemoto et al. | 463/31 |
| 5,833,537 | A | 11/1998 | Barrie | 463/21 |
| 5,890,962 | A | 4/1999 | Takemoto | 463/20 |
| 5,980,384 | A | 11/1999 | Barrie | 463/16 |
| 6,027,115 | A | 2/2000 | Griswold et al. | 273/143 R |
| 6,036,188 | A | 3/2000 | Gomez et al. | 273/118 R |
| 6,038,188 | A | 3/2000 | Akamatsu | 365/226 |
| 6,056,642 | A | 5/2000 | Bennett | 463/20 |
| 6,086,066 | A | 7/2000 | Takeuchi et al. | 273/143 R |
| 6,089,977 | A | 7/2000 | Bennett | 463/20 |
| 6,095,921 | A | 8/2000 | Walker et al. | 463/20 |
| 6,135,884 | A | 10/2000 | Hedrick et al. | 463/20 |
| 6,135,885 | A | 10/2000 | Lermusiaux | 463/20 |
| 6,164,645 | A | 12/2000 | Weiss | 273/138.2 |
| 6,181,301 | B1 | 1/2001 | Inoguchi et al. | 345/5 |
| 6,224,482 | B1 | 5/2001 | Bennett | 463/20 |
| 6,234,897 | B1 | 5/2001 | Frohm et al. | 463/20 |
| 6,251,013 | B1 | 6/2001 | Bennett | 463/13 |
| 6,261,177 | B1 | 7/2001 | Bennett | 463/16 |
| 6,270,411 | B1 | 8/2001 | Gura et al. | 463/20 |
| 6,290,600 | B1 | 9/2001 | Glasson | 463/20 |
| 6,364,766 | B1 | 4/2002 | Anderson et al. | 463/16 |
| 6,368,216 | B1 | 4/2002 | Hedrick et al. | 463/20 |
| 6,375,568 | B1 | 4/2002 | Roffman et al. | 463/26 |
| 6,419,579 | B1 | 7/2002 | Bennett | 463/20 |
| 6,517,432 | B1 | 2/2003 | Jaffe | 463/16 |
| 6,517,433 | B2 * | 2/2003 | Loose et al. | 463/20 |
| 6,695,696 | B1 | 2/2004 | Kaminkow | 463/16 |
| 6,817,946 | B2 * | 11/2004 | Motegi et al. | 463/31 |
| 6,937,298 | B2 | 8/2005 | Okada | 349/58 |
| 7,004,836 | B2 | 2/2006 | Kaminkow et al. | 463/20 |
| 7,011,581 | B2 | 3/2006 | Cole et al. | 463/16 |
| 7,097,560 | B2 | 8/2006 | Okada | 463/20 |
| 7,121,942 | B2 * | 10/2006 | Baerlocher | 463/20 |
| 7,140,963 | B2 | 11/2006 | Kojima | 463/20 |
| 7,159,865 | B2 | 1/2007 | Okada | 273/143 |
| 7,160,187 | B2 | 1/2007 | Loose et al. | 463/20 |
| 7,204,753 | B2 | 4/2007 | Ozaki et al. | 463/16 |
| 7,237,775 | B2 * | 7/2007 | Thomas et al. | 273/143 R |
| 7,255,643 | B2 | 8/2007 | Ozaki et al. | 463/20 |
| 7,455,588 | B2 | 11/2008 | Webb et al. | 463/20 |
| 7,530,894 | B1 * | 5/2009 | Marks et al. | 463/20 |
| 7,878,903 | B2 * | 2/2011 | Chan | 463/31 |
| 7,950,994 | B2 * | 5/2011 | Berman et al. | 463/20 |
| 8,137,179 | B2 * | 3/2012 | Jensen et al. | 463/20 |
| 8,298,064 | B2 * | 10/2012 | Bennett et al. | 463/20 |
| 8,360,846 | B1 * | 1/2013 | Bennett et al. | 463/20 |
| 2001/0031658 | A1 | 10/2001 | Ozaki et al. | 463/16 |
| 2002/0039918 | A1 * | 4/2002 | Anderson et al. | 463/16 |
| 2002/0123378 | A1 * | 9/2002 | Bucknall et al. | 463/16 |
| 2002/0175466 | A1 * | 11/2002 | Loose et al. | 273/143 R |
| 2003/0087690 | A1 | 5/2003 | Loose et al. | 463/20 |
| 2003/0234489 | A1 | 12/2003 | Okada | 273/236 |
| 2003/0236118 | A1 | 12/2003 | Okada | 463/20 |
| 2004/0014520 | A1 | 1/2004 | Okada | 463/20 |
| 2004/0029636 | A1 | 2/2004 | Wells | 463/32 |
| 2004/0048646 | A1 * | 3/2004 | Visocnik | 463/16 |
| 2004/0053673 | A1 * | 3/2004 | Mishra | 463/20 |
| 2004/0063490 | A1 | 4/2004 | Okada | 463/20 |
| 2004/0116178 | A1 | 6/2004 | Okada | 463/20 |
| 2004/0147303 | A1 | 7/2004 | Imura et al. | 463/16 |
| 2004/0150162 | A1 | 8/2004 | Okada | 273/292 |
| 2004/0152502 | A1 | 8/2004 | Okada | 463/16 |
| 2004/0166925 | A1 | 8/2004 | Emori et al. | 463/20 |
| 2004/0166926 | A1 * | 8/2004 | Adachi et al. | 463/20 |
| 2004/0171418 | A1 | 9/2004 | Okada | 463/20 |
| 2004/0198485 | A1 | 10/2004 | Loose et al. | 463/20 |
| 2004/0207154 | A1 | 10/2004 | Okada | 273/138.1 |
| 2004/0209666 | A1 | 10/2004 | Tashiro et al. | 463/20 |
| 2004/0209667 | A1 | 10/2004 | Emori et al. | 463/20 |
| 2004/0209668 | A1 | 10/2004 | Okada | 463/20 |
| 2004/0209670 | A1 | 10/2004 | Adachi et al. | 463/20 |
| 2004/0209671 | A1 | 10/2004 | Okada | 463/20 |
| 2004/0209672 | A1 | 10/2004 | Okada | 463/20 |
| 2004/0209678 | A1 | 10/2004 | Okada | 463/30 |
| 2004/0209681 | A1 | 10/2004 | Emori et al. | 463/31 |
| 2004/0209682 | A1 | 10/2004 | Okada | 463/31 |
| 2004/0214635 | A1 | 10/2004 | Okada | 463/30 |
| 2004/0214637 | A1 | 10/2004 | Nonaka | 463/31 |
| 2004/0219965 | A1 | 11/2004 | Okada | 463/16 |
| 2004/0224747 | A1 | 11/2004 | Okada | 463/16 |
| 2004/0224758 | A1 | 11/2004 | Okada et al. | 463/31 |
| 2004/0227286 | A1 | 11/2004 | Tanimura et al. | 273/143 |
| 2004/0227866 | A1 | 11/2004 | Okada | 349/58 |
| 2004/0229680 | A1 | 11/2004 | Hoshino et al. | 463/20 |
| 2004/0229686 | A1 | 11/2004 | Tanimura et al. | 463/30 |
| 2004/0266510 | A1 | 12/2004 | Kojima | 463/16 |
| 2004/0266521 | A1 | 12/2004 | Kojima | 463/20 |
| 2005/0032571 | A1 | 2/2005 | Asonuma | 463/20 |
| 2005/0130737 | A1 | 6/2005 | Englman et al. | 463/25 |
| 2005/0153775 | A1 | 7/2005 | Griswold et al. | 463/30 |
| 2005/0187003 | A1 | 8/2005 | Adachi et al. | 463/16 |
| 2005/0192090 | A1 | 9/2005 | Muir et al. | 463/30 |
| 2005/0239530 | A1 * | 10/2005 | Walker et al. | 463/16 |
| 2005/0272500 | A1 | 12/2005 | Tanimura et al. | 463/20 |
| 2005/0282616 | A1 | 12/2005 | Tanimura et al. | 463/20 |
| 2005/0282617 | A1 | 12/2005 | Sekiguchi et al. | 463/20 |
| 2005/0282620 | A1 * | 12/2005 | Marks et al. | 463/20 |
| 2006/0025215 | A1 * | 2/2006 | Thomas | 463/30 |
| 2006/0058097 | A1 * | 3/2006 | Berman et al. | 463/20 |
| 2006/0252496 | A1 | 11/2006 | Rasmussen | 463/20 |
| 2007/0004513 | A1 | 1/2007 | Wells et al. | 463/31 |
| 2007/0015565 | A1 * | 1/2007 | Chan | 463/20 |
| 2008/0108411 | A1 * | 5/2008 | Jensen et al. | 463/20 |
| 2009/0117983 | A1 * | 5/2009 | Visser | 463/20 |
| 2009/0186682 | A1 * | 7/2009 | Kim | 463/20 |
| 2009/0305770 | A1 * | 12/2009 | Bennett et al. | 463/20 |
| 2010/0210343 | A1 * | 8/2010 | Englman et al. | 463/20 |

FOREIGN PATENT DOCUMENTS

| | | | | |
|---|---|---|---|---|
| GB | 2 124 505 | A | 2/1984 | A63D 13/00 |
| GB | 2 349 494 | A | 11/2000 | G07F 17/32 |
| JP | 61-279272 | | 12/1986 | A63F 7/02 |
| JP | 02-019182 | | 1/1990 | A63F 7/02 |
| JP | 04-109977 | | 4/1992 | A63F 5/04 |
| JP | A-H04-114676 | | 4/1992 | A63F 5/04 |
| JP | A-H04-341288 | | 11/1992 | A63F 7/02 |
| JP | 05-177043 | | 7/1993 | A63F 7/02 |
| JP | 06-039085 | | 2/1994 | A63F 5/04 |
| JP | 07-16340 | | 1/1995 | A63F 7/02 |
| JP | 60-061079 | | 4/1995 | B05D 1/28 |
| JP | 07-124290 | | 5/1995 | A63F 5/04 |
| JP | 4072 99189 | A | 11/1995 | |
| JP | 08-103541 | | 4/1996 | A63F 7/02 |
| JP | 2531253 | | 1/1997 | A47F 11/06 |
| JP | 9-207625 | | 8/1997 | B60K 35/00 |
| JP | 10-071228 | | 3/1998 | A63F 5/04 |
| JP | 10-091076 | | 4/1998 | G09F 9/00 |
| JP | 10-305130 | | 11/1998 | A63F 5/04 |
| JP | 10-328398 | | 11/1998 | G07F 9/10 |
| JP | 11-090017 | | 4/1999 | A63F 7/02 |
| JP | 11-099240 | | 4/1999 | A63F 5/04 |
| JP | 11-137774 | | 5/1999 | A63F 5/04 |
| JP | 11-152970 | | 6/1999 | E06B 9/02 |
| JP | 11-153970 | | 6/1999 | G09F 9/33 |
| JP | 11-244451 | | 9/1999 | G63F 5/04 |
| JP | 2000-51314 | | 2/2000 | A63F 5/04 |
| JP | 2000-65097 | | 3/2000 | A63F 5/04 |
| JP | 2000-68925 | | 3/2000 | A63F 5/04 |
| JP | 2000-262738 | | 9/2000 | A63F 13/00 |
| JP | 2002-113150 | | 4/2002 | A63F 5/04 |
| JP | 2003-310951 | A | 11/2003 | A63F 7/02 |
| WO | WO 99/53454 | A1 | 10/1999 | G07F 17/34 |
| WO | WO 99/64997 | A1 | 12/1999 | G07F 17/34 |
| WO | WO 00/32286 | A1 | 6/2000 | A63F 9/22 |

(56) References Cited

FOREIGN PATENT DOCUMENTS

| | | | |
|---|---|---|---|
| WO | WO 2006/036948 | A2 | 4/2006 |
| WO | WO 2006/124976 | A1 | 11/2006 |
| WO | WO 2007/011717 | A2 | 1/2007 |

OTHER PUBLICATIONS

"Big Games Safari" Product Sheet, IGT, 24 pages (2000).
"Cabby Cash™" Product Sheet, Anchor Gaming, 2 pages (2000).
"Congo Quest™" Product Sheet, Anchor Gaming, 2 pages (2000).
"Fishin' Buddies™" Product Sheet, Anchor Gaming, 2 pages (2000).
Legato, Frank, "The Full Monty," Strictly Slots, pp. 48-50 (Jun. 1999).
"Goooaal!" Product Sheet, Bally Gaming, Inc., 2 pages (2000).
"Great Whites" Product Sheet, VLC, Inc., 2 pages (2000).
"Jackpot Stampede Deluxe™" Product Sheet, WMS Gaming Inc., 2 pages (1997).
"Loaded Dice" Product Sheet, Konami Gaming, 2 pages (2000).
"Neptune's Pearls" Product Sheet, Unidesa Gaming, 4 pages (1998).
"Penguin Pays" Product Sheet, Aristocrat Incorporated, 2 pages (1998).
"Stroke of Luck™" Product Sheet, WMS Gaming Inc., 2 pages (1997).
"Wild Cougar" Article, Strictly Slots, p. 44 (Feb. 1999).
"Yahtzee® Brand Video Game" Product Brochure, Hasbro, Inc., 2 pages (2000).
Decision of Refusal of Aug. 30, 2005, issued from Japanese Patent Office for the corresponding Japanese application No. 2000-051314 (10 pages).
Third Party Submission dated Jun. 11, 2012 (2 pages).

* cited by examiner

WAGERING GAME WITH OVERLAYING TRANSMISSIVE DISPLAY FOR PROVIDING ENHANCED GAME FEATURES

RELATED APPLICATIONS

This application is a continuation of U.S. patent application Ser. No. 12/271,460, filed Nov. 14, 2008, which is a continuation-in-part of U.S. patent application Ser. No. 11/922,455, filed Dec. 18, 2007, which is a U.S. nationalization of PCT/US2006/026005, filed Jun. 30, 2006, which claims priority to U.S. Provisional Application No. 60/695,563, filed Jun. 30, 2005. All three of these applications are incorporated by reference in their entireties.

FIELD OF THE INVENTION

The present invention relates generally to gaming machines and methods of playing wagering games and, more particularly, to wagering games with enhanced features provided by video images superimposed over a display of the gaming machines.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines.

Another way to increase the entertainment value of a game is to enhance the display of the gaming machines. For gaming machines with video displays, improvements in video technology have enabled the display of richer and more colorful graphics. For mechanical displays, however, the improvements early on were less technologically advanced. For example, some mechanical reel symbols were colored by actually backlighting the symbols with colored lighting elements. Sometimes the reel itself might contain electroluminescent elements that defined one or more reel symbols. To display a symbol in multiple colors or formats, multiple electroluminescent elements were needed for that symbol.

Recent advances in transmissive display technology have made it possible to more easily modify the appearance of a mechanical display. The transmissive display is essentially a transparent video display that is superimposed over the mechanical display. The transmissive display is then operated to display selected video images superimposed over the mechanical display. The video images may include translucent portions so that the underlying mechanical display is visible, but in an altered state (i.e., different color, texture, etc.). The video images may also include opaque portions so as to completely block out the underlying mechanical display. For information regarding the use of transmissive display technology in gaming machines, the reader is referred to commonly-assigned U.S. Published Application No. 20040198485, entitled "Gaming Machine with Superimposed Display Image," filed on Nov. 7, 2003 and incorporated herein by reference in its entirety.

The above-described transmissive display technology gives wagering game designers the capability and flexibility to more easily design and modify the appearance of mechanical displays. Accordingly, there is a need to develop new and improved wagering games for mechanical displays using this technology, with features that take full advantage of the capabilities of the transmissive display to thereby enhance the entertainment value of the wagering games.

SUMMARY OF THE INVENTION

The present invention is directed to a gaming machine for conducting a wagering game that includes a game display operable to display an outcome of a wagering game in response to a wager. The gaming machine further includes a transmissive display overlaying the game display and operable to selectively display transmissive features over the game display. The transmissive display is positioned in front of the game display directly in the player's line of sight, including game-play regions at which symbols appear and regions above, below, between, and to the sides the game-play regions.

According to one aspect of the invention, the transmissive features of the transmissive display are configured to change a play mechanic associated with the wagering game.

According to another aspect of the invention, the transmissive features of the transmissive display are configured to provide interactive player-control and player-selection elements for the wagering game.

According to yet another aspect of the invention, the transmissive features of the transmissive display are configured to provide bonus features associated with the gaming machine.

According to still another aspect of the invention, the game display has a plurality of reels and reel symbols, and the transmissive features of the transmissive display are configured to alter the appearance of the reel symbols.

Where the gaming machine includes a touch screen overlaying the transmissive display, the transmissive features of the transmissive display are configured to facilitate player inputs to the gaming machine through the touch screen.

According to yet another aspect of the invention, a computer-readable storage medium is encoded with instructions for directing a gaming machine to implement the above features.

Additional aspects of the invention will be apparent to those of ordinary skill in the art in view of the detailed description of various embodiments, which is made with reference to the drawings, a brief description of which is provided below.

DETAILED DESCRIPTION

Figure 1:
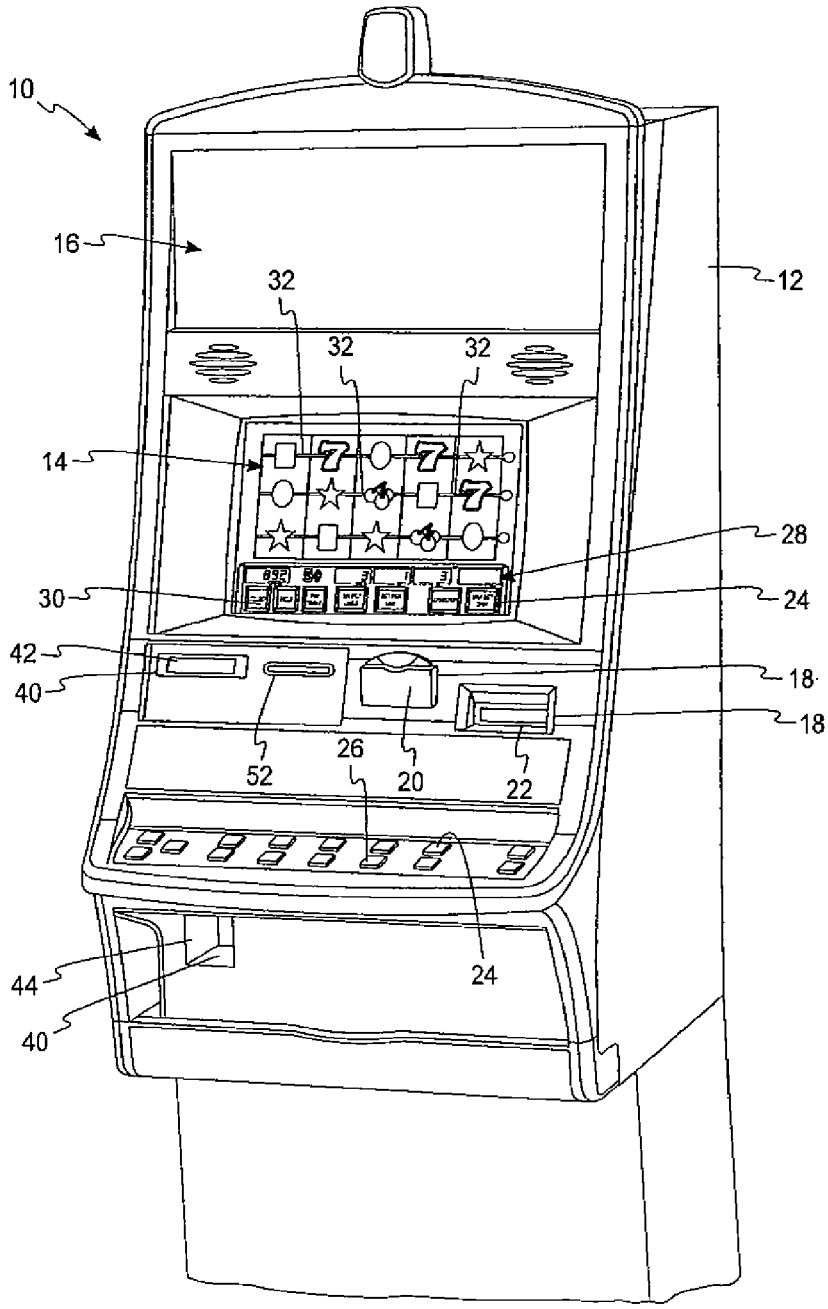
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
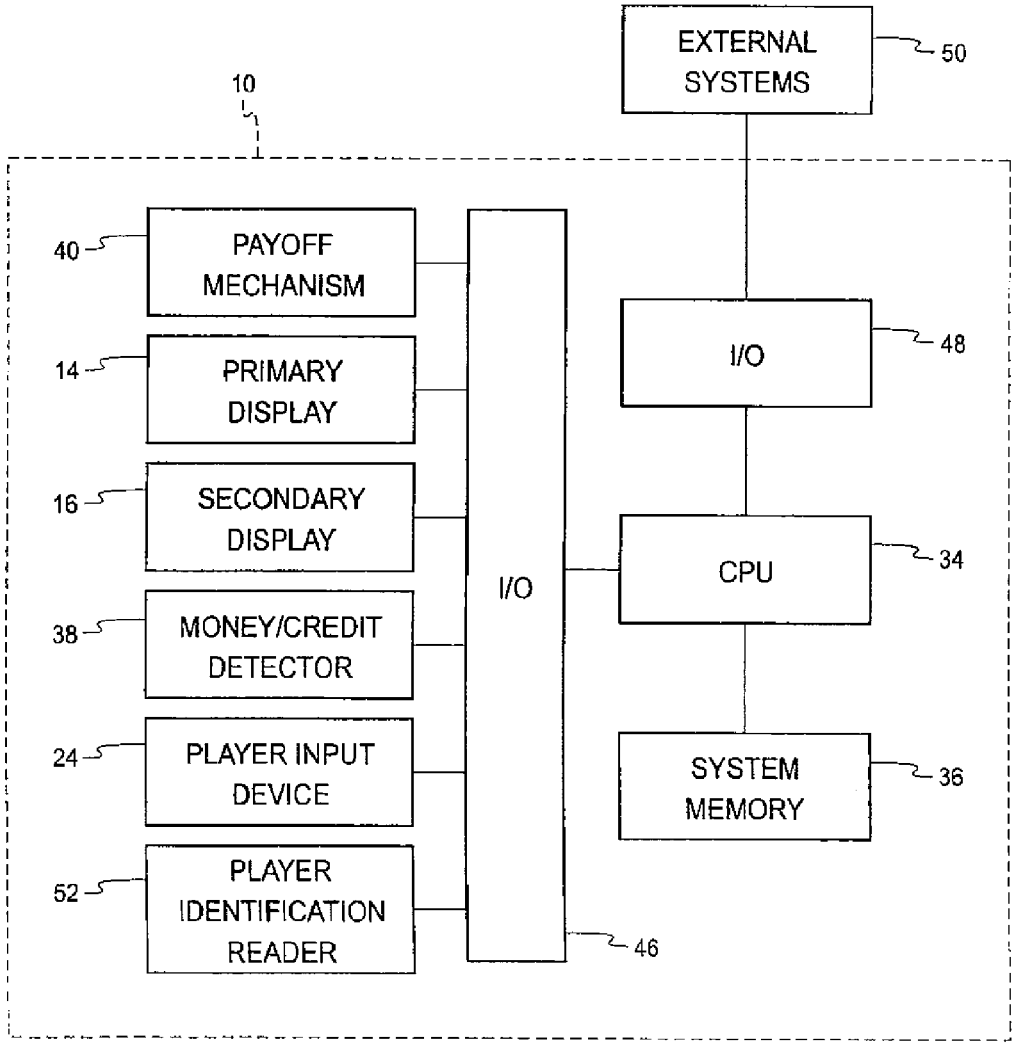
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
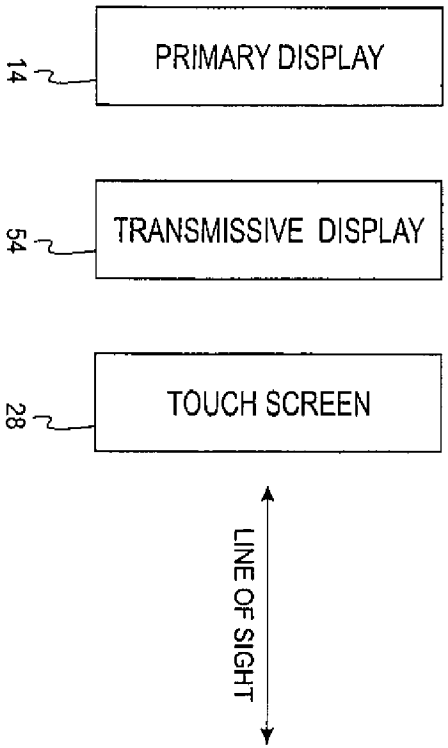
FIG. 3 is block diagram of a transmissive display superimposed on a primary/secondary display of a gaming machine.

FIG. 3 illustrates a block diagram of the gaming machine 10 where a transmissive display 54 has been superimposed on the display 14. The transmissive display 54 may be a transmissive liquid crystal display (LCD) or any other suitable transmissive display and is positioned directly in the player's line of sight as he or she views the display 14. In some embodiments, the touch screen 28 is then mounted over the transmissive display 54 in the player's line of sight. As mentioned above, the transmissive display 54 provides video images that may be selectively made transparent, semi-transparent (i.e., translucent), or opaque in selected places. This allows preselected images on the transmissive display 54 to be displayed over certain portions of the primary display 14, with the result that certain areas of the primary display 14 are either altered in some way (e.g., highlighted, colored, etc.), or completely blocked by the images on the transmissive display 54. All video images on the transmissive display may be rendered in two-dimensional or three-dimensional graphics (e.g., using Flash Macromedia™). The images may be played back (e.g., from a recording stored on the gaming machine 10), streamed (e.g., from the gaming network), or received as a TV signal (e.g., either broadcast or via cable). The images may be animated, or they may be real-life images, either prerecorded (e.g., in the case of marketing/promotional material) or as live footage, and the format of the video images may be an analog format, a standard digital format, or a high-definition (HD) digital format. Using the transmissive display 54 in this way allows numerous types of improvements and enhancements to be made to the appearance of the display 14 in real time and during on-going game play.

Thus far, the transmissive display 54 has only been described as being superimposed on the primary display 14. It is also possible, however, to superimpose the transmissive display 54 on the secondary display 16 as well without departing from the scope of the invention. Still, in most embodiments, the primary display 14 is the one with the transmissive display 54 superimposed thereon. The reason for this is because in gaming machines 10 that involve the transmissive display 54, most of the time, the primary display 14 is a mechanical display, such as mechanical reels (e.g., for a slot machine), a mechanical wheel (e.g., a roulette game), one or more dice, a pachinko board, or other board game. For examples of the types of mechanical displays that may be used with the transmissive display 54, the reader is again referred to U.S. Published Application No. 20040198485, incorporated previously by reference. In alternative embodiments, however, the primary display 14 may be a video based display such as a CRT or LCD. In further alternative embodiments, the primary display 14 may be a diorama presenting a three-dimensional model of a game environment. The diorama may be stationary in some implementations, or it may slide or move around in one or more dimensions.

Figure 4A:
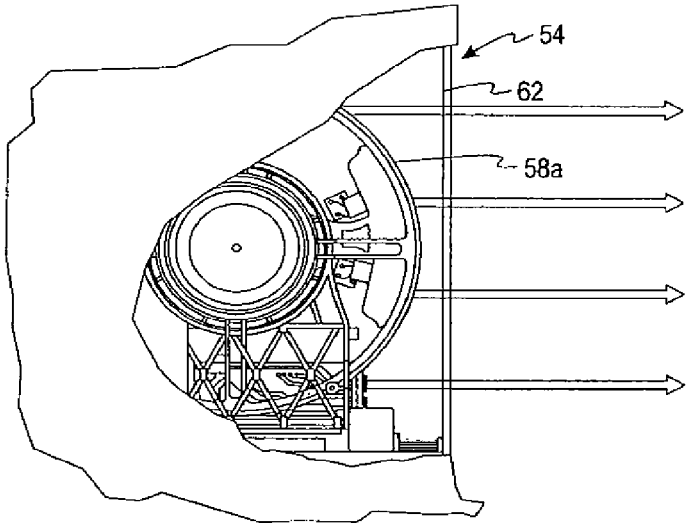
FIGS. 4*a*-4*b* are side views of a transmissive display superimposed on a primary display of a gaming machine.
Figure 4B:
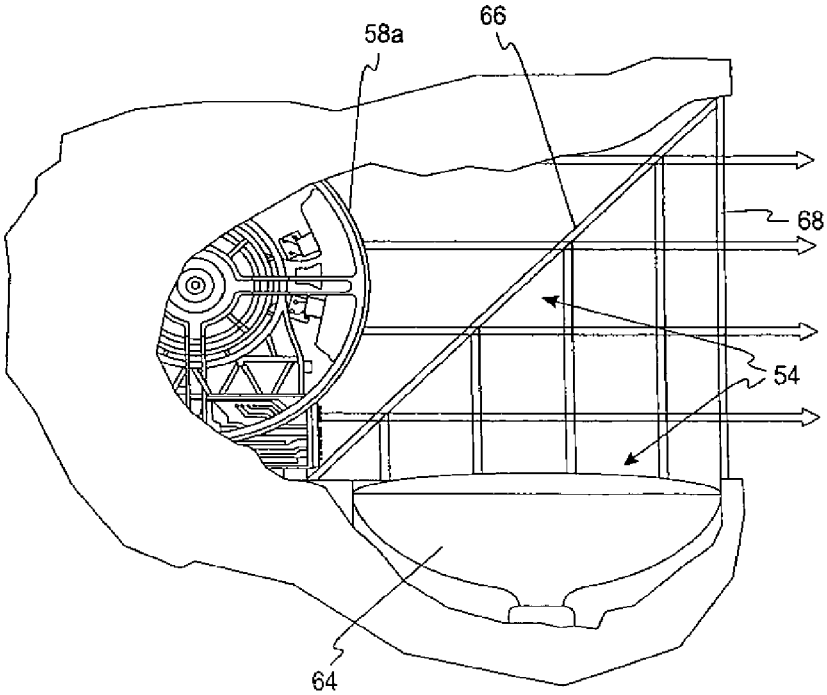

FIGS. 4*a* and 4*b* illustrate exemplary implementations of the transmissive display 54 where the gaming machine 10 employs mechanical reels as the primary display 14. In the examples of FIGS. 4*a* and 4*b*, there are three mechanical reels 58*a*, 58*b*, and 58*c* (only reel 58*a* seen here), each of which has a plurality of reel symbols, one shown at 60 (see FIG. 5*a*). At any given time, only three of the reel symbols 60 on each reel 58*a-c* are visible, resulting in a three-by-three array of reel symbols 60 that together represent a randomly selected outcome of the wagering game. The transmissive display 54 is then positioned over the mechanical reels 58*a-c* and may be either a direct image (FIG. 4*a*) or a virtual image (FIG. 4*b*) display.

Where the transmissive display 54 is a direct image display, as in FIG. 4*a*, the direct image may be generated by a flat panel transmissive video display 62 positioned in front of the reels 58*a-c*. Such a flat panel transmissive video display 62 may be, for example, a transmissive liquid crystal display (LCD) commercially available from LG Phillips LCD Co., Ltd., of Seoul, Korea, Sharp Electronics Corp. of Tokyo, Japan, and other display manufacturers. The flat panel transmissive video display 62 is preferably preconfigured with the touch screen 28 (see FIG. 3) mounted to a front surface of the display 62.

Where the transmissive display 54 is a virtual image display, as in FIG. 4*b*, the virtual image may be generated by a projection arrangement, for example, a video display 64 and a partially reflective minor 66. The partially reflective mirror 66 is positioned at an angle (e.g., 45 degrees) over the mechanical reels 58*a-c* so as to project video images from the video display 64 mounted below the reels 58*a-c* towards the player. The video display 64, which may also be mounted above the reels 58*a-c*, may be a CRT, LCD, dot matrix, LED, electro-luminescent, or other type of video display known to those having ordinary skill in the art. Video images from the video display 64 are reflected off the partially reflective mirror 66 so that they appear to the player to be superimposed over the mechanical reels 58*a-c*. In some embodiments, the transmissive display 54 further includes a transparent glass cover/window 68 positioned over the partially reflective minor 66 that protects the mirror 66 and is optionally configured with the touch screen 28.

FIGS. 5*a*-5*d* illustrate examples of the various display functions that may be performed using video images from the transmissive display 54 superimposed on the mechanical reels 58*a-c* of the primary display 14. In general, the various functions may be organized into four main categories: (1) informational, where the transmissive display 54 is used to provide instructions and other information to the player; (2) interactive, where the transmissive display 54 is used to facilitate interaction between the player and the gaming machine 10; (3) emphasis, where the transmissive display 54 is used to highlight certain portions of the primary display 14; and supplemental, where the transmissive display 54 is used to provide additional graphics and/or symbols, either in conjunction with or independent of the primary display 14. These four display function categories are discussed below with respect to FIGS. 5*a*-5*d*.

Figure 5A:
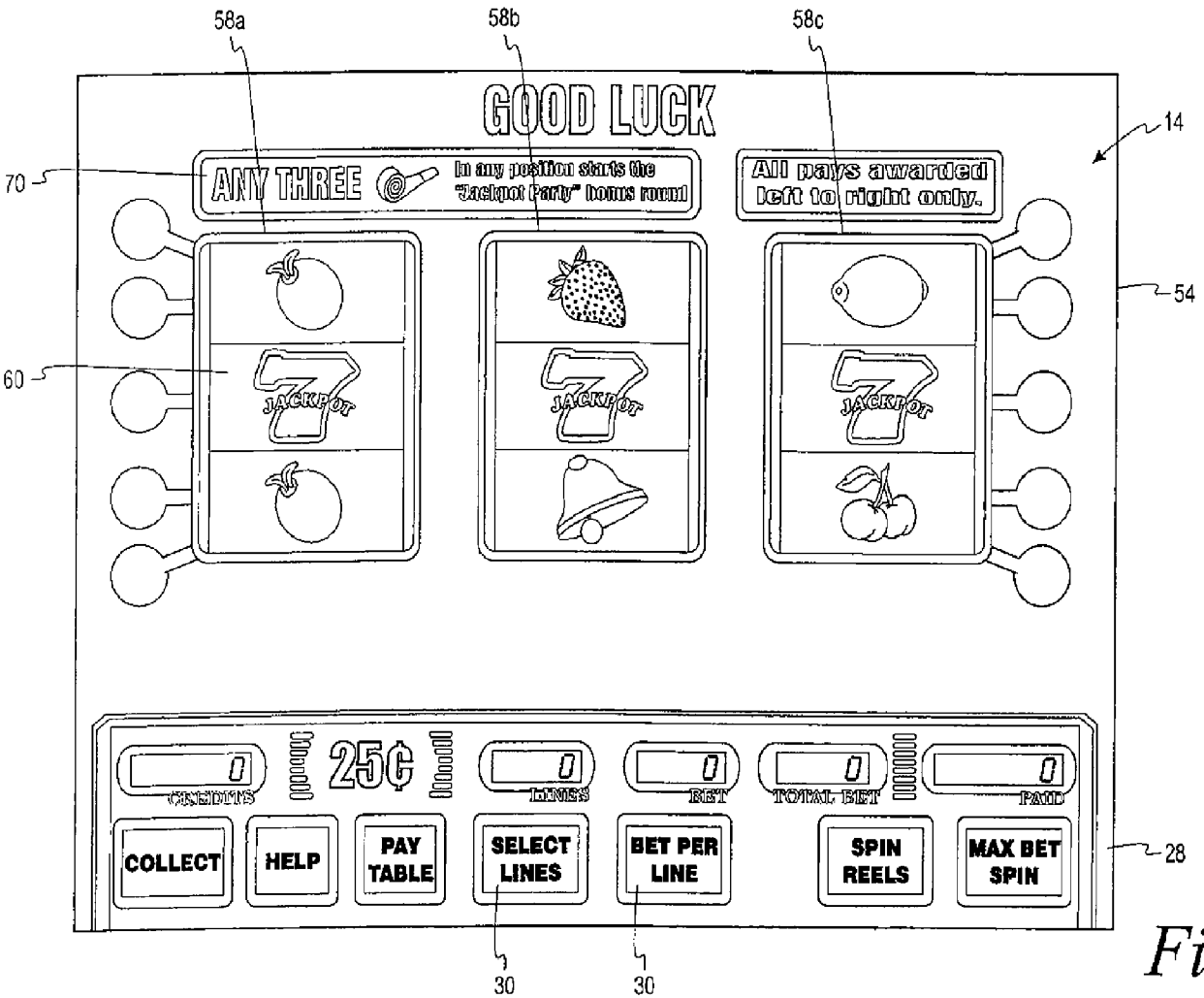
FIGS. 5*a*-5*f* illustrate examples of various display functions that may be performed using a transmissive display superimposed on a primary display of a gaming machine.

FIG. 5*a* illustrates an example of the informational category, where the transmissive display is used to provide instructions and other information to the player. As can be seen in this example, the primary display 14 of the gaming machine 10 includes the mechanical reels 58*a-c*, each of which includes a plurality of reel symbols 60. The transmissive display 54 is superimposed on the primary display 14 relative to the player's line of sight so that the player sees the transmissive display 54 first before seeing the primary display 14. Alpha and/or numeric characters, indicated generally at 70, may then be displayed over the mechanical reels 58*a-c* via the transmissive display 54 to instruct the player regarding the rules of the game and the various game options that are available. The instructions and other information may be provided at any time throughout the gaming session as needed. In some embodiments, the touch screen 28 is also present and is superimposed on the transmissive display 54, as illustrated by the touch screen buttons 30.

Figure 5B:
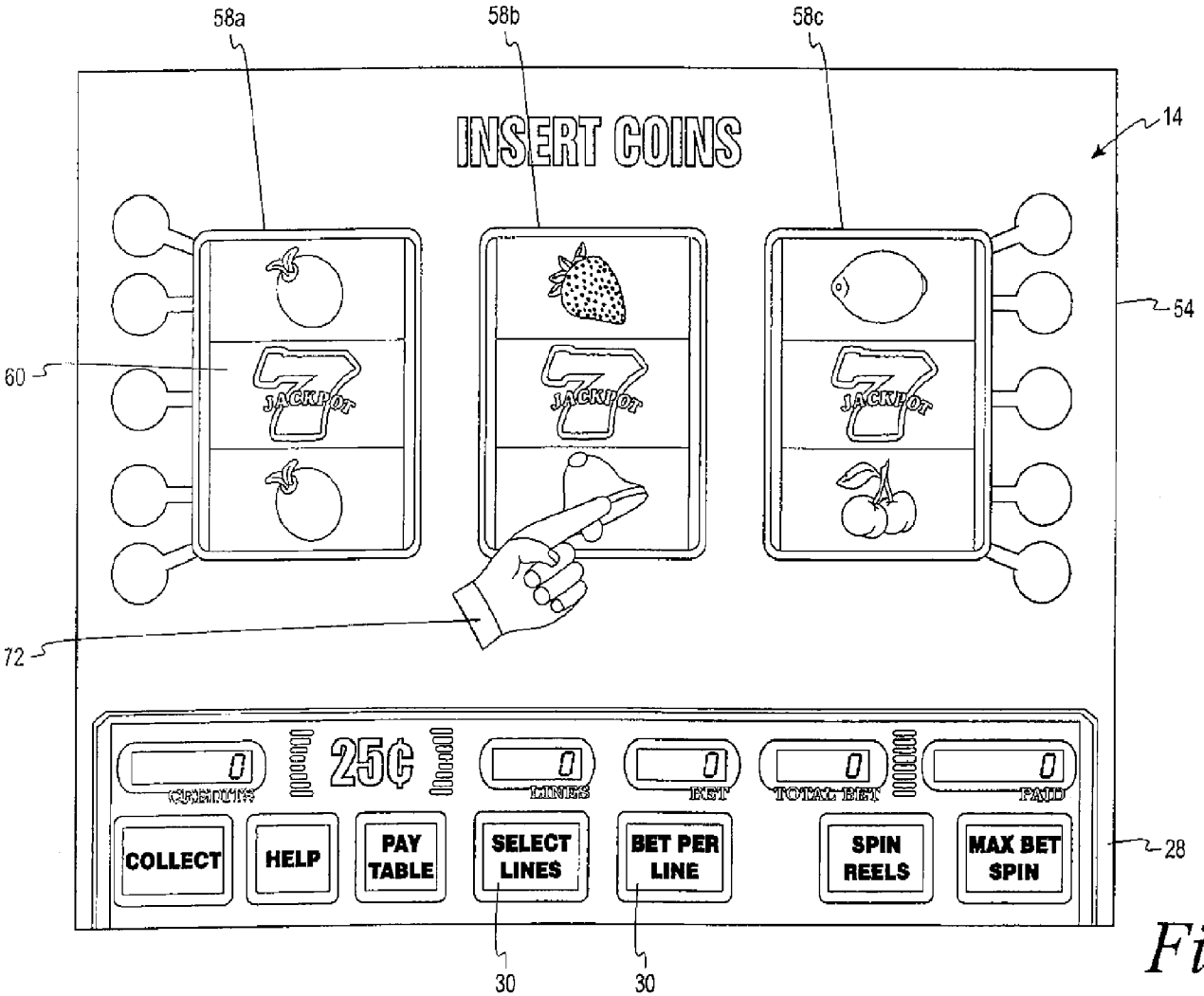

FIG. 5*b* illustrates an example of the interactive category, where the transmissive display 54 is used to facilitate interaction between the player and the gaming machine 10. In this example, a hand icon or other graphical pointer 72 is displayed over the mechanical reels 58*a-c* using the transmissive display 54. The movement of the graphical pointer 72 about the transmissive display 54 may then be controlled by the player via a standard pointing device (e.g., mouse, trackball, touchpad, etc.). This allows the player to interact with the gaming machine 10, for example, by selecting paylines, pressing buttons 30, initiating the spinning of the reels 58*a-c*, and so forth.

Figure 5C:
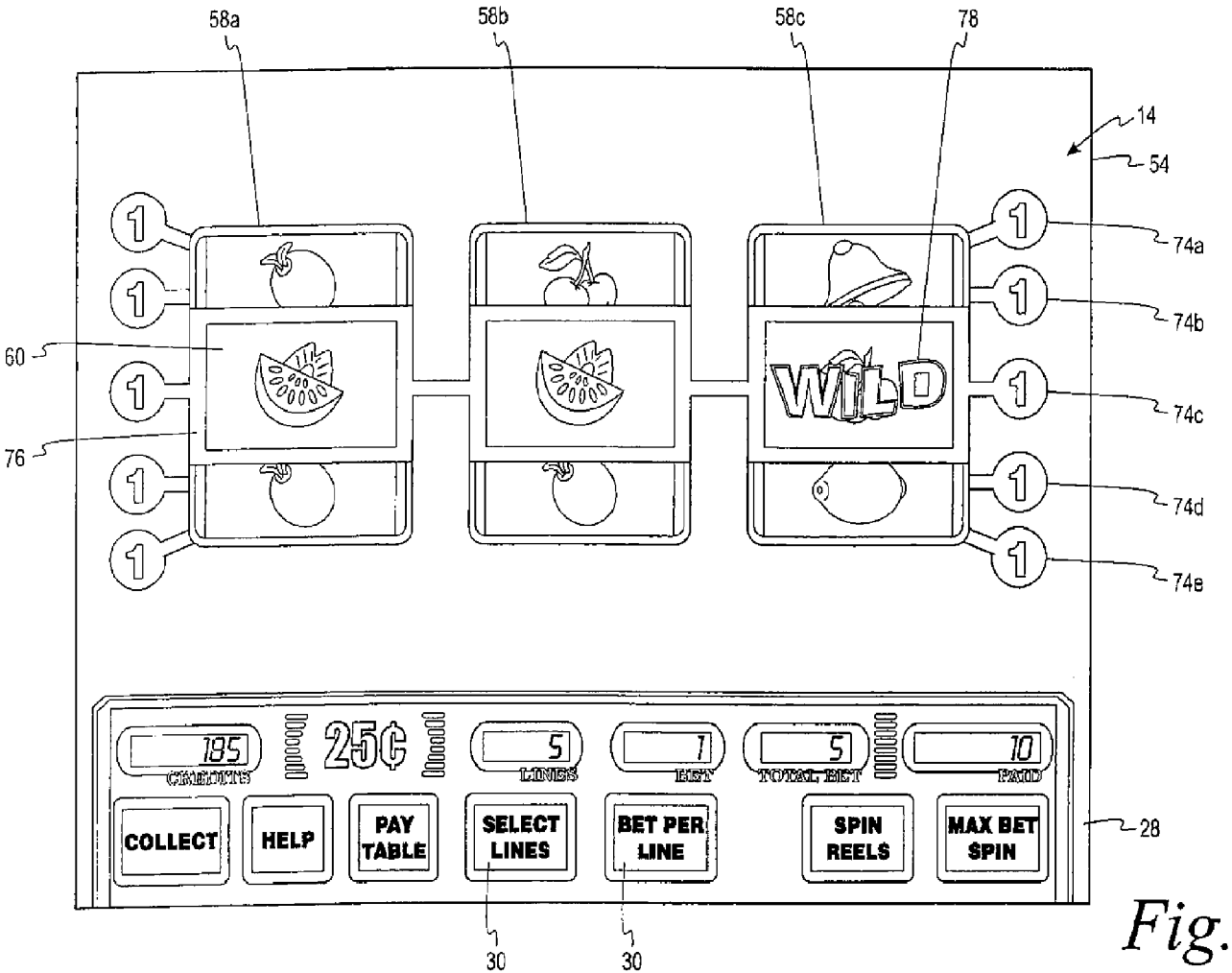

FIG. 5*c* illustrates an example of the emphasis category, where the transmissive display 54 is used to highlight certain portions of the primary display 14. Here, the transmissive display 54 is used to superimpose a plurality of paylines 74*a*, 74*b*, 74*c*, 74*d*, and 74*e* on the primary display 14. When certain reel symbols 60 of the mechanical reels 58*a-c* line up on one or more of the paylines 74*a*-74*e*, the transmissive display 54 lights up, encircles, or otherwise emphasizes the appropriate paylines 74*a*-74*e*, as indicated at 76. In the example of FIG. 5*c*, the transmissive display 54 may also be used to replace one of the mechanical reel symbols 60 with another symbol. Here, the transmissive display 54 is used to overlay the middle symbol of the third reel 58*c* with a "wild" symbol 78, thereby changing a potentially non-winning outcome into a winning outcome.

Figure 5D:
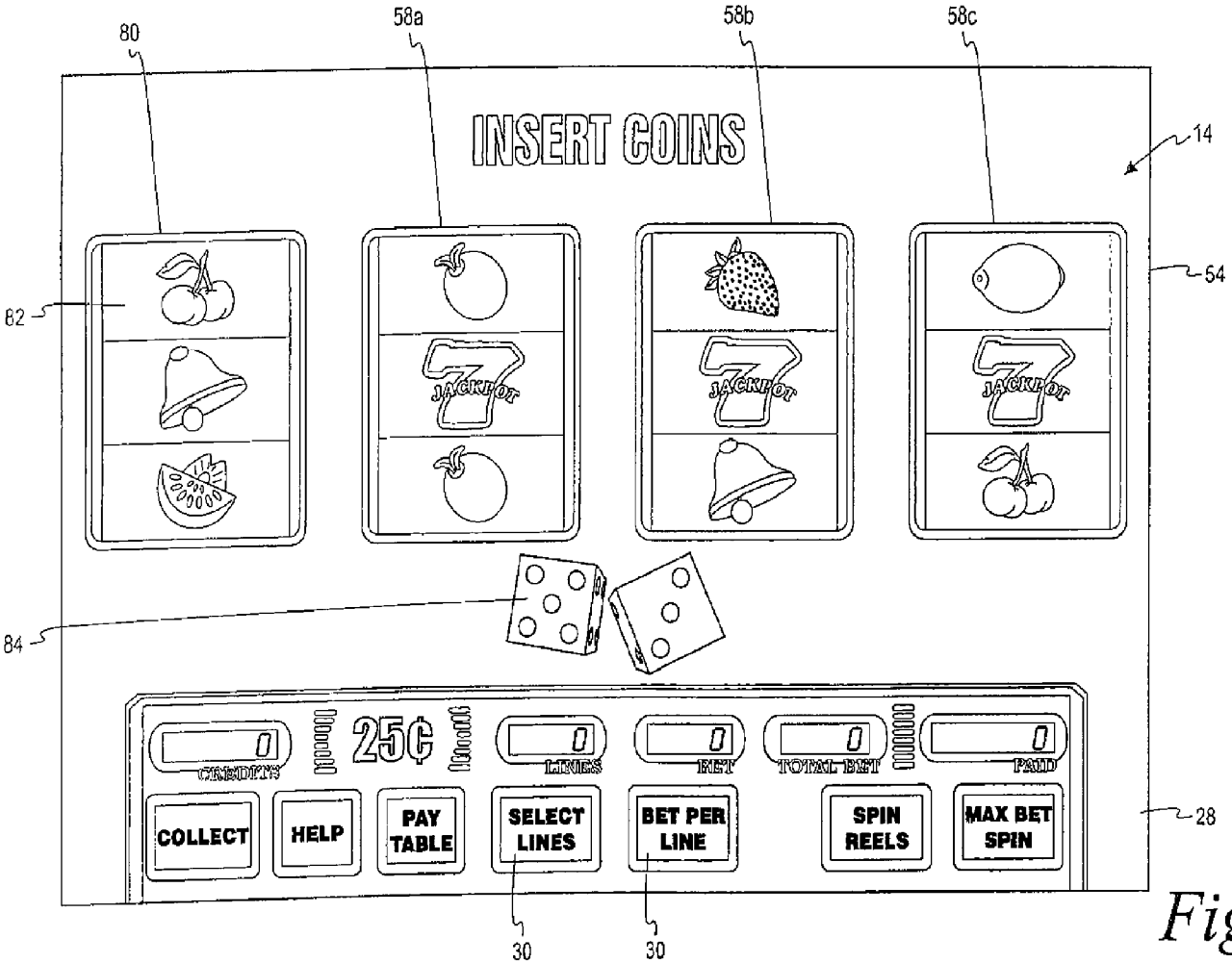

FIG. 5*d* illustrates an example of the supplemental category, where the transmissive display 54 is used to provide additional graphics and/or symbols, either in conjunction with or independent of the primary display 14. In the example shown, an additional reel 80 having a plurality of reel symbols 82 is superimposed on the primary display 14 adjacent to the mechanical reels 58*a*-58*c*. The additional reel 80 may be the same size as the mechanical reels 58*a*-58*c*, in which case the effect is to convert the primary display 14 from a three-by-three array of reel symbols to a four-by-three array. This results in an increased number of possible symbol combinations and, hence, more possible winning outcomes. Alternatively, the additional reel 80 may be operated independently of the mechanical reels 58*a*-58*c*, for example, as part of a separate bonus game. In that case, the additional reel 80 may be smaller the mechanical reels 58*a*-58*c* (i.e., a micro-reel) or it may be larger. In some embodiments, an entirely different game, such as a dice game (see dice 84), may also be played on the transmissive display 54. The new game may be played independently of the game on the primary display 14 or as a supplement to the game on the primary display 14.

Each of the previously listed FIGS. 5*a*-5*d* and the corresponding text describe the various display functions that may be performed using the transmissive display 54 mounted over the mechanical reels 58*a-c*. Following is a brief description of the various game features, organized roughly into five categories, that may be implemented by using one or more of the functions shown and described with respect to FIGS. 5*a*-5*d*.

Group 1: Enhancing the Underlying Reels

In Group 1, the transmissive display 54 over the mechanical reels 58*a-c* may be used to change the play mechanics associated with the underlying reels. Following are examples of Group 1 features.

ALTERED OR MOVING PAYLINE. The transmissive display 54 over the mechanical reels 58*a-c* may create a nontraditional payline across the reel symbols 60. For example, if the most beneficial symbol combination that is displayed to the player is not aligned along a horizontal payline, but is instead aligned along a nontraditional zigzagged payline, then the nontraditional payline may be highlighted on the transmissive display 54 to provide a payout to the player. Additionally, the payline may move between a plurality of different payline positions, which means that both the mechanical reels 58*a-c* and the payline are moving before indicating the randomly selected outcomes.

UNLOCKED REEL. The transmissive display 54 may be made dark (i.e., opaque) over an underlying mechanical display, such as a mechanical reel. Upon occurrence of a triggering event, the transmissive display 54 may be adjusted to reveal the underlying mechanical reel, which may, for example, be a bonus reel that results in a higher payout for the player.

ROVING SYMBOL CATCH. The transmissive display 54 may be used to provide highlighting around symbol locations. The highlighting may be randomly moved from symbol location to symbol location. In addition to the basic game that is played on the mechanical reels 58*a-c*, if a certain symbol is highlighted (i.e., caught) by the highlighted portion, then an additional payout may be achieved.

EXTRA VIDEO REEL. In addition to the basic game that is played with the mechanical reels 58*a-c*, the transmissive display 54 may be used to display a second slot-related game whereby video symbols rotate at the same time or at nearly the same time as the mechanical reels 58*a-c*. In one embodiment, the transmissive display 54 illustrates three moving video reels with only one symbol at a time being displayed, such that there is only one horizontal payline. The portion of the transmissive display 54 displaying the video reels is directly adjacent to and below the displayed region for mechanical reels 58*a-c*.

ADJUSTABLE ARRAY SIZE. The transmissive display 54 may be used to adjust the size of the displayed region. For example, the transmissive display 54 may be used to display additional reels and/or reel symbols 60 on either side of, and/or above and below, the three mechanical reels 58*a-c* to increase the size of the displayed region. This allows the size of the displayed region to be increased up to a five-by-five array. The additional reels and/or reel symbols 60 may appear as part of a bonus game only, or they may be displayed as part of the basic game. It is also possible for the transmissive display 54 to block out portions of the mechanical reels 58*a-c* to decrease the size of the array so that a smaller region is displayed.

PAYLINE RIGHT-TO-LEFT. In general, payline evaluation in a wagering game is performed from left to right. However, in some wagering games, if a predetermined symbol or symbol combination appears (e.g., at a predetermined location on the mechanical reels 58*a-c*), then the payline evaluation is right-to-left (or up-and-down). The transmissive display 54 may be used to graphically illustrate the change in the payline evaluation to the players.

ANY SYMBOL LEFT-TO-RIGHT. Some wagering games involving reels pay for a winning symbol combination, moving from left to right, regardless of the location of any traditional payline. In other words, as long as a symbol appears anywhere on the display region of the mechanical reels 58*a-c*, that symbol may be used to develop a winning symbol combination. In such a game, there may be multiple winning symbol combinations across the reels, but the player only receives a payout for the best symbol combination. The transmissive display 54 may be used to highlight the best winning symbol combinations when this game format is used. This is beneficial because it is often difficult for the player to identify a winning combination or the best winning combination among several winning combinations.

IDENTIFYING HOT PAYLINE. The wagering game may be played in a manner that allows a player who wins on one active payline to achieve a game enhancement associated with that "hot" payline for the next spin or spins. For example, each time the player achieves a winning combination along that active payline, a multiplier is increased, extra credit is given, a bonus (e.g., free spins) is triggered, and so forth. Alternatively, the "hot" payline may be randomly enabled or selected by the player without regard to the reel symbols. The transmissive display 54 may be used to identify the "hot" active payline and also identify the game enhancement that is associated with that payline for the next spin or spins.

REELS IN BLANKS. The transmissive display 54 may be used to take advantage of the blanks in the mechanical reels 58*a-c* by creating the appearance of an independent reel in the blanks. When the mechanical reels 58*a-c* result in a blank on an active payline, the transmissive display 54 may be used to display a virtual reel, or the reel symbols of the virtual reel, spinning in the blank space. The virtual reel may be a micro-reel. The symbol of the virtual reel then replaces the blank for that round. The benefit to the player is a possible winning combination where there would otherwise not be a win by virtue of the virtual reel.

SELECTING PAYLINES. The transmissive display 54 may be used in conjunction with the touch screen 28 to allow the player to select the paylines. For example, the transmissive display 54 may display handles or other graphical indicators for each payline. The player may select a payline by touching the handle for that payline. For example, the player may select the "hot" payline described above with respect to the IDENTIFYING HOT PAYLINE feature. The handle may then light up to indicate the payline has been activated. The player may also incrementally raise the wager amount on any active payline by touching the handle for that payline.

PICK PATTERN SIDE BETS. The transmissive display 54 may be used in conjunction with the touch screen 28 to allow the player to pick reel positions on the mechanical reels 58*a-c*, forming a pattern. For example, the player may pick a diagonal pattern across the array of mechanical reel symbols. The transmissive display 54 then highlights each reel location selected. When the mechanical reels 58*a-c* stop, the player is awarded a predetermined credit value for each symbol, if any, that lands in the selected pattern. In some embodiments, the gaming machine 10 (or gaming network) may pick the pattern instead of the player.

Group 2: Modifying the Underlying Reel Symbols

In Group 2, the transmissive display 54 over the mechanical reels 58*a-c* may be used to change the reel symbols 60 associated with the underlying reels. Following are examples of Group 2 features.

EXPANDING AND/OR ROVING WILD. If a certain symbol appears on one of the mechanical reels 58*a-c*, then the transmissive display 54 overlays the entire displayed portion (i.e., the one-by-three array) of that mechanical reel with a symbol or symbols so that the entire reel becomes wild. In another embodiment, a certain symbol appearing on one of the mechanical reels 58*a-c* causes the transmissive display 54 to transform the symbols that are horizontally adjacent to that symbol into wild symbols. Thus, the transmissive display 54 may be used to show wild symbols expanding in any direction across multiple reels. Furthermore, a wild symbol may appear on the transmissive display 54 that moves from symbol location to symbol location as the mechanical reels 58*a-c* are spinning. Once the mechanical reels 58*a-c* stop spinning, the moving wild symbol also stops, and the reel symbol 60 over which the wild symbol stops becomes a wild symbol for any active payline upon which it is aligned.

CHARACTER WILD. The transmissive display 54 may be used to show an animated character moving over the mechanical reels 58*a-c* while the reels are spinning. Wherever the character is when the mechanical reels 58*a-c* stop, that mechanical reel or reel symbol 60 is turned into a wild. The movement of the character is independent of the outcome of the mechanical reels 58*a-c*. In one embodiment, the transmissive display 54 shows the character as a seal that slides down one of the mechanical reels 58*a-c*. Whichever reel the seal slides down, the transmissive display 54 transforms that entire reel into wild symbols. The seal may also reveal a multiplier at the conclusion of its slide. In another embodiment, the character roams randomly over the mechanical reels 58*a-c*. The reel or reel-symbol location on which the character stops is transformed by the transmissive display 54 into a wild symbol.

Figure 5E:
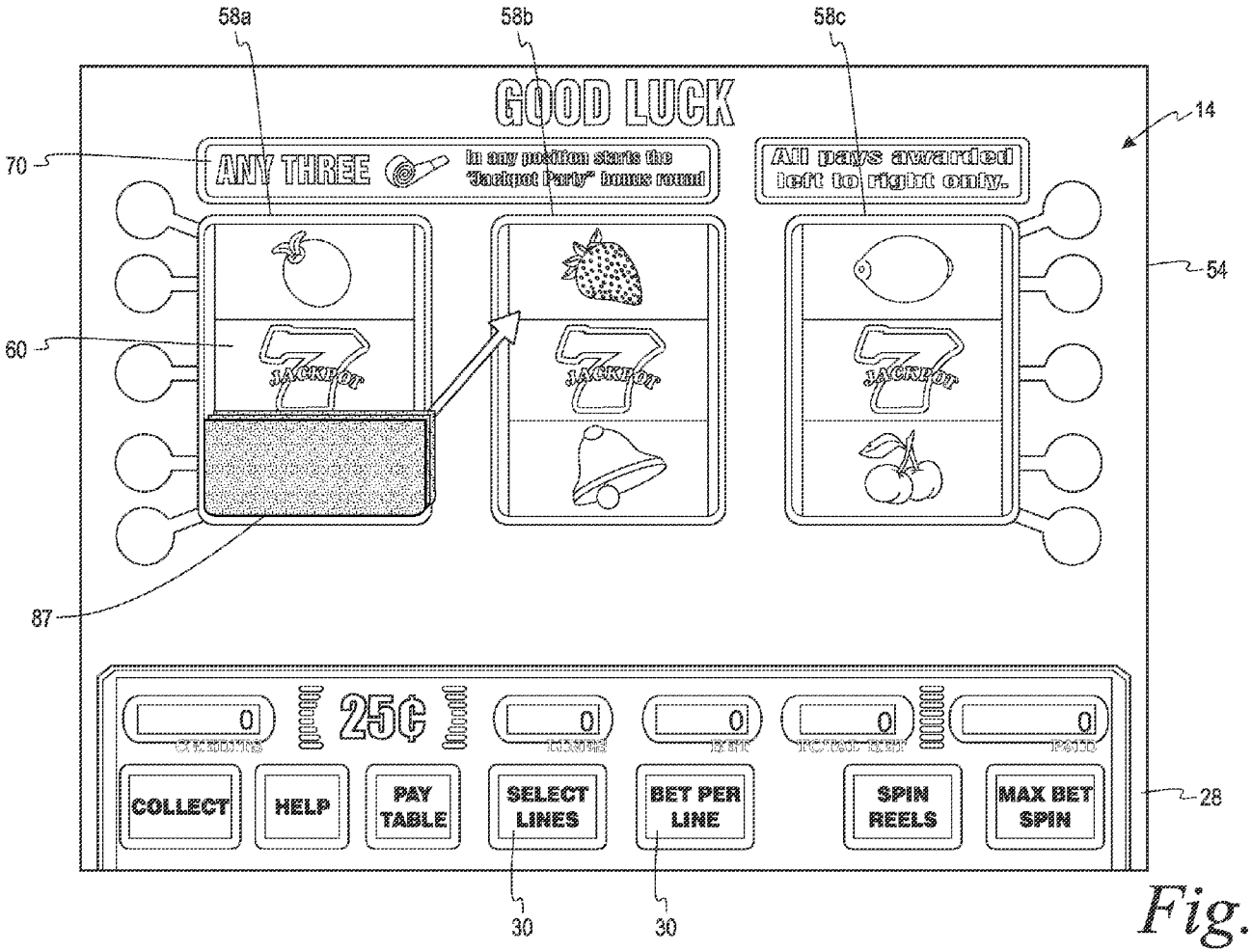
Figure 5F:
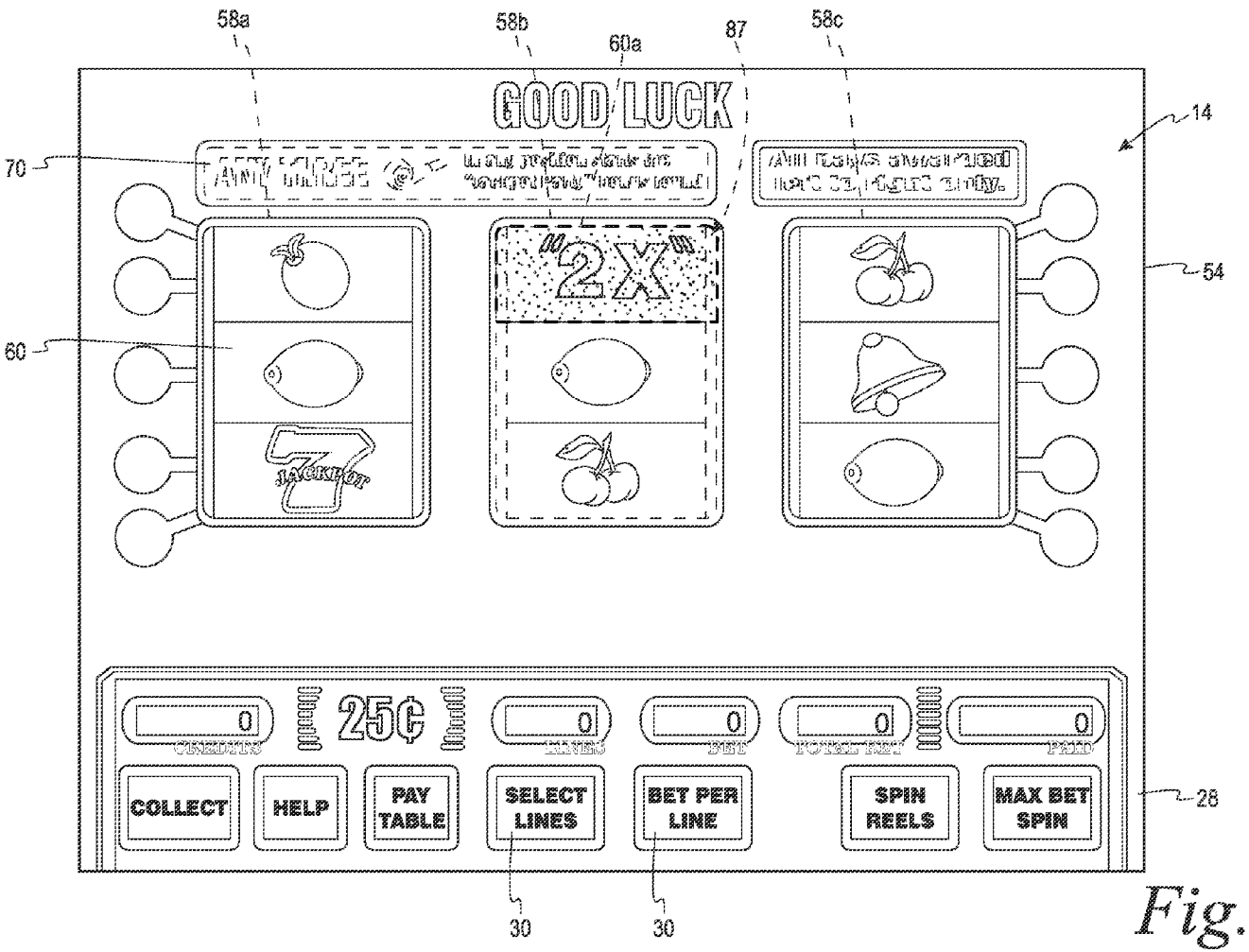

CHARACTER-REEL INTERACTION. The transmissive display 54 may be used to display an animated character interacting with the mechanical reels 58*a-c*, For example, the animated character may be shown spinning the reels, pulling/pushing on the reels, bumping the reels, casting a spell on the reels, or otherwise affecting the operation of the reels. The interaction between the character and the reels may nudge the reels in one or more directions, cause the reels to be respun, slow/stop the reels, and so forth. The result may be a winning outcome and/or an enhanced payout to the player, HIDDEN SYMBOL REVEALED. The transmissive display 54 may also be used to create opaque regions 87 over certain reel symbol 60 locations to block out those symbol locations. In response to a triggering event, the opaque regions become translucent or transparent to reveal the underlying hidden symbols. As an example, an opaque region 87 or regions may be randomly moved across various symbol locations (as shown in FIG. 5*e*) as the mechanical reels 58*a-c* are spinning and stopping. If a certain reel symbol 60*a* (e.g., the "2X multiplier" symbol in FIG. 5*f*) is located under the moving opaque region 87 when all of the mechanical reels 58*a-c* stop, then the payout, if any, is multiplied by a multiplier.

DYNAMIC MULTIPLIER. The mechanical reels 58*a-c* may include a symbol that is a variable or dynamic multiplier (e.g., "?×"). If that dynamic multiplier is aligned along an active payline, the transmissive display 54 may be used to display the value for the dynamic multiplier by illustrating a certain number (e.g., 2, 4, 8, etc.) over the dynamic multiplier symbol. This value, which multiplies any payout award to the player, may be randomly assigned for that particular spin of the mechanical reels 58*a-c*.

BOUNCING ENHANCEMENT SYMBOL. The transmissive display 54 may be used to show an enhancement symbol bouncing randomly over the mechanical reels 58*a-c*. Wherever the bouncing enhancement symbol stops, that reel position is enhanced. For example, the enhancement symbol may be a multiplier symbol, If the multiplier symbol lands on a reel location in a winning payline, the payout for that payline is multiplied. If the enhancement symbol is a wild symbol, whichever reel position the wild symbol lands on, that reel position is transformed into a wild symbol. The bouncing enhancement symbol may be triggered by a predetermined symbol or symbol combination, such as the mechanical reels 58*a-c* resulting in three blanks, either anywhere or on an active payline. The bouncing symbol may have multiple random aspects, such as the location on which it stops and the type of enhancement that it brings to the reel location or the symbol location (e.g. wild, multiplier, guaranteed minimum payout, etc.).

MICRO-REEL ON SYMBOL LOCATION. At least one symbol location can be used to display a miniature (i.e., micro) set of video reels, allowing the player another chance to win a payout or to enhance an existing payout achieved on the mechanical reels 58*a-c*. For example, if a player achieves a winning symbol combination along an active payline, and a certain "micro-reel" symbol appears along that active payline on the transmissive display 54, then the player is permitted to play the secondary "micro-reel" slot game that takes place within that symbol location.

BRIGHT-LIT "BLANKS" WITH VIDEO SYMBOL. The transmissive display 54 may be used for multiple functions in the same wagering game. For example, bright backlighting may be used to project through the transmissive display 54, which provide some type of symbol or message indicating that the symbol for that symbol location is about to change. The backlighting may then be terminated and the enhanced symbol be displayed in that symbol location on the transmissive display 54. As such, the backlighting creates a virtual blank on the mechanical reel and that location.

SYMBOL APPEARS ON BLANK. The mechanical reels 58*a-c* may be provided with blanks. When one of the blanks appears over an active payline, the transmissive display 54 is used to display a symbol over that blank location. As such, the blank location on the mechanical reel becomes a variable or dynamic symbol that may be changed as needed. This allows the player to achieve a winning outcome from an otherwise non-winning outcome.

HOLDING SYMBOL OR SYMBOL LOCATION. The transmissive display 54 may be used to hold a desirable symbol along a payline even though the underlying mechanical reel is respun. In other words, the player is allowed to maintain a desirable symbol by holding the symbol in the desired symbol location and, hopefully, the other mechanical reels 58*a-c* will produce symbols that result in a winning combination when added to the held symbol. The transmissive display 54 may also allow a player to hold a certain symbol location, such that if a certain symbol lands within the held symbol location, an additional award is provided to the player. In this embodiment, the transmissive display 54 is used to highlight the held symbol location by outlining or highlighting, preferably with color. In some embodiments, the gaming machine 10 may select the symbol or symbol location to be held, either by design (i.e., upon occurrence of a predetermined event) or randomly. If the respun mechanical reels 58*a-c* produce a matching symbol or if a certain symbol lands within the held symbol location, an additional award is provided to the player.

MYSTERY SCATTER/MYSTERY PAY. Some symbols are not required to be aligned along an active payline to produce a winning outcome. These symbols are often referred to as "scatter" symbols, providing a "scatter" payout. The transmissive display 54 may be used to convert randomly selected symbols on the mechanical reels 58*a-c* into scatter symbols. The transmissive display 54 may also be used to convert the symbols in an active payline that is an otherwise non-winning outcome into a winning outcome. For example, where three blanks appear in a row on the mechanical reels 58*a-c*, the transmissive display 54 may be used to transform three blanks into wild symbols. The transmissive display 54 may also be used to convert blanks into symbols that are part of the game. For example, all blanks may be turned into cherries, and so forth.

ANIMATED COLORING. In some gaming machines 10, the reel symbols 60 are subjected to a second evaluation where the payout is based on the color of the symbols. Thus, for example, a red "7" may have a higher payout than a white "7," and so on. The transmissive display 54 may be used to visually change the color of a reel symbol 60 on the mechanical reels 58*a-c* in an animated manner upon occurrence of a predetermined symbol or symbol combination, resulting in a potentially higher payout. For example, the transmissive display 54 may show the reel symbol 60 filling up with a different color, or the reel symbol 60 may be rotated through several colors before stopping on a randomly selected color.

VIDEO REEL ON TOP OF MECHANICAL REEL. The transmissive display 54 may be used to show a virtual reel on top of the mechanical reel 58*a-c*. The virtual reel may be spinning nearly synchronously with the mechanical reel 58*a-c* and may be used to modify the color and/or other aspects of the symbols 60 on the mechanical reel 58*a-c* while spinning, or to replace one or more symbols 60 on the mechanical reel 58*a-c* with other symbols.

COMBINATION SYMBOLS. Combination symbols are symbols that are spread over two or more reel locations. Each reel-symbol location contains only a portion of the symbol, for example, half of a watermelon, so that all portions are required for the player to be awarded that symbol. The transmissive display 54 may be used to provide the other portion or portions of the symbol. For example, a mechanical reel symbol 60 may only provide the Ying portion of the Ying and Yang symbol. The transmissive display 54 may then be used to provide the missing Yang portion. Several implementations are possible for providing the missing portions, including one or more additional reels that are horizontally adjacent to the mechanical reels 58*a-c*.

REPEATED SYMBOL WIN. In some gaming machines 10, the same symbol in the same location on a different reel results in an increased payout if the active payline is a winning payline. The transmissive display 54 may be used to provide the duplicate symbol via an additional reel. For example, a certain symbol (or any symbol) may land in a particular location on the mechanical reel 58*a-c*. If the same symbol lands on the same location on the virtual reel shown on the transmissive display 54, the player is awarded the increased payout. The REPEATED SYMBOL WIN feature may apply to all symbols in a winning symbol combination. If the transmissive display 54 displays the same symbol at any location where an underlying symbol on the mechanical reel is involved in a winning combination, then the payout is increased. If two symbols on the transmissive display 54 are overlying two winning symbols in a single winning symbol combination, then the payout may be further increased. The symbols on the transmissive display 54 may randomly move across the transmissive display 54 as the underlying mechanical reels 58*a-c* spin, then stop when the mechanical reels 58*a-c* stop. In addition, one or more of the "duplicate" symbols on the virtual reels may actually be game enhancement symbols (e.g., wild symbols) that enhance the reel symbols. Furthermore, the symbols on the virtual reels may be added to the symbols on the mechanical reels 58*a-c*, transforming a three-symbol win, for example, into a four-symbol win. Thus, it is also possible in a five-by-three array for a player to achieve up to a ten-symbol win, where five of the winning symbols are shown on the mechanical reels and five of the winning symbols are shown on the overlying transmissive display 54. In these embodiments, the pay table is extended to include additional payouts covering the extra winning outcomes, and the transmissive display 54 may be used to visualize the extension of the pay table.

PLACE YOUR WILD SPOT (SCATTER TOO). The transmissive display 54 may be used in conjunction with the touch screen 28 to allow the player to select a wild spot. The transmissive display 54 may provide a video overlay that the player may touch to select the location of the wild spot on the mechanical reels 58*a-c*. That location then becomes a wild when the reel stops, and/or all symbols that resemble the symbol landing in that location become wild when the reel stops. Similarly, the player may also select locations on the mechanical reels 58*a-c* that, if a certain symbol stops in that location, a scatter payout is achieved (or a higher than normal scatter payout is achieved if a normal scatter symbol lands in that location). Alternatively, the locations for the wild and/or scatter symbols may be randomly selected.

ARRAY GHOSTED OVER REELS. The transmissive display 54 may be used to provide a second array that is ghosted over the mechanical reels 58*a-c*. The second array is special in that it may include only wilds, multiplier, and blanks. Any wild, multiplier, or blank of the second array that lands on an active payline of the mechanical reels 58*a-c* replaces the underlying symbol 60 on the mechanical reels 58*a-c*.

Group 3: Adding Control And Selection Elements

In Group 3, the transmissive display 54 may be used to provide certain interactive player control and player selection elements for the mechanical reels 58*a-c*. Following are examples of Group 3 features.

SHOW UNDISPLAYED PORTION OF MECHANICAL REELS. The transmissive display 54 may be used to preview the reel symbols 60 on the mechanical reel that are not yet visible (i.e., are just outside the array of reel symbols 60). For example, the transmissive display 54 may be used to show which reel symbols 60 are located directly below the lowermost row of the array (and hence out of sight) or directly above the uppermost row. The player may wish to view these reel symbols 60 where the gaming machine 10 is a type that provides the player the opportunity to move one of the mechanical reels 58*a-c* after it has stopped (i.e., a NUDGE feature) in order to achieve a better result.

TOUCH SYMBOL TO REVEAL BONUS. The mechanical reels 58*a-c* may have a certain symbol that provides one of a plurality of different bonuses to the player. If this bonus-triggering symbol is displayed on a stopped mechanical reel within the displayed region of the mechanical reels 58*a-c*, then the player may be instructed to touch the transmissive display 54 over the bonus-triggering symbol to reveal the bonus. Alternatively, if the bonus-triggering symbol is displayed on one of the mechanical reels 58*a-c*, the transmissive display 54 may be used to display a variety of player-selectable elements, each of which hides a certain bonus for the player (e.g., a multiplier, a credit amount, an invitation to play a distinct bonus game, etc.). The player is then instructed to select one of the elements, and is awarded the bonus that is revealed after his or her selection.

STOP OR BRAKE FEATURE FOR MECHANICAL REELS. The transmissive display 54 may be used in conjunction with the touch screen 28 to allow a player to slow the movement of one or more of the mechanical reels 58*a-c*. For example, the player may touch a certain area of the touch screen 28 that is shown as a button 30 or lever on the transmissive display 54. In some instances, the player's touching of the transmissive display 54 may cause one of the mechanical reels 58*a-c* to stop in a certain location. These features may be provided even on gaming devices that have a purely random outcome by providing a certain mystery bonus after each game. The mystery bonus results in the payout associated with the random outcome that was intended to be achieved had the player not used the stop or brake feature on the transmissive display 54.

SELECTING REEL TO RESPIN. The transmissive display 54 may be used to allow a player to respin one or more of the underlying mechanical reels 58*a-c*. For example, the transmissive display 54 may include an up-arrow or a down-arrow that the player touches to instruct the gaming machine 10 to respin the reel in a certain direction. The respin feature may be awarded to the player for collecting certain beneficial symbols during the gaming session.

BLIND SELECTION OF BENEFICIAL FEATURE. The transmissive display 54 may be used to display a plurality of player-selectable elements, each of which masks a certain beneficial feature that the player may use to affect the outcome of the mechanical reels 58*a-c*. For example, after achieving a non-winning result, three shells may appear on the transmissive display 54. The transmissive display 54 may indicate to the player that the selection of a certain shell will cause the respinning of the reel number that is revealed by the shell. Thus, if the player chooses a shell that reveals "Reel Number 1," the first reel will be respun. In a similar fashion, a plurality of player-selectable elements associated with the nudging of a certain reel or reels 58*a-c* may be selected by the player and subsequently revealed. This feature may be used in conjunction with the SHOW UNDISPLAYED PORTION OF MECHANICAL REELS feature, which was described above.

BLIND SELECTION FOR SUBSEQUENTLY USED FEATURE. The transmissive display 54 may display a plurality of different player-selectable elements, each of which masks a certain symbol or feature that may affect the outcome of subsequent spins of the mechanical reels 58*a-c*. The array of player-selectable elements may perform a variety of functions, including masking symbols or features such as multipliers, transforming symbols on the mechanical reels 58*a-c* into wild symbols, creating scatter payout symbols, and so forth.

CREDIT/CASH METER CHANGES. In multi-denominational gaming machines 10, the transmissive display 54 may be used in conjunction with the touch screen 28 to allow a player to change the token denomination. For example, the transmissive display 54 may provide an overlay showing the various available token denominations, such as pennies, nickels, quarters, dollars, and so on. The player may then switch the token denomination (e.g., from a nickel game to a penny game) by touching the appropriate denomination indicator displayed on the transmissive display 54.

TOUCH SYMBOL TO REVEAL PAYOUT. The transmissive display 54 may be used in conjunction with the touch screen 28 to allow a player to touch a symbol to reveal a payout and/or a pay table associated with the payout. For example, the transmissive display 54 may animate a pop-up window showing the payout and/or the pay table associated with the payout when the player touches one of the symbols in the winning outcome. The player may also view, via another pop-up window, the potential payout of a symbol (i.e., before he or she places a wager or spins the reels). The transmissive display 54 may also allow the player to make side bets on a selected symbol, modify the appearance or function of a selected symbol, view a pay history for a selected symbol, and/or adjust a wager on an individual payline, and the like, through the pop-up window. For information regarding such a pop-up window, the reader is referred to commonly-assigned U.S. Published Application No. 20040219968 entitled "Gaming machine with interactive pop-up windows," filed on Nov. 4, 2004, and incorporated herein by reference.

Group 4: Enhancing Player Interface

In Group 4, the transmissive display 54 may be used to allow the player to create inputs to the gaming machine 10 through a touch screen 28 that is associated with the transmissive display 54. Following are examples of Group 4 features.

PLAYER LOGIN AND INFORMATION ENTRY. The transmissive display 54 may be used in conjunction with the touch screen 28 to facilitate player login and information entry. For example, the transmissive display 54 may provide an overlay of a virtual keyboard that the player can use to enter his or her identification, club membership number, and other information. The player may then enter his or her information by touching the appropriate keys on the virtual keyboard. The transmissive display 54 may also be used to track the player, for example, by displaying the wagering activity of the player over a certain period of time and/or the frequency that the player plays certain gaming machines, and so forth.

REEL NUDGES. The transmissive display 54 may be used to nudge or otherwise move the reels. For example, if a certain winning symbol combination has just barely missed because a needed symbol is slightly off of the active payline (e.g., by one reel symbol position), then the transmissive display 54 may be used to illustrate the needed symbol moving onto the active payline, creating the winning combination. It is also possible for the player to interact with the transmissive display 54, which has the overlying touch screen 28, by moving his or her finger upwardly or downwardly to cause the video version of the symbol to be displayed along the active payline, thus achieving the desired winning combination. The transmissive display 54 may also be used to effectuate physical nudges. For example, the transmissive display 54 may display arrows or other pointers that randomly move over the mechanical reels 58*a-c*. If the arrows or other pointers land on one of the mechanical reels 58*a-c*, the gaming machine 10 physically nudges that reel in the direction pointed to by the arrows or other pointers. If the player is permitted to assist in the nudging, this feature may also be considered an ADDING CONTROL AND SELECTION ELEMENTS feature.

PAYLINE INDICATOR. Usually, a payline that extends across the mechanical reels 58*a-c* terminates at both ends in payline indicators (see 74*a-e* in FIG. 5*c*), which may be highlighted to show that the player has chosen to play (i.e., activate) that payline. The transmissive display 54 may be used to provide dynamic highlighting of payline indicators for the underlying mechanical reels 58*a-c*. In one example, the payline indicators of an active payline may be presented in a bright green color, while payline indicators for inactive paylines may be a subtle red. In another example, the symbols or symbol locations in the winning payline may be highlighted, or the non-winning symbols or symbol locations may be deemphasized (e.g., darkened, grayed out, etc.), or both. Furthermore, if a player achieves a winning combination along an active payline, the transmissive display 54 may dynamically illustrate the win to the player with a variety of video graphics on the payline indicator, as well as on the active payline. For example, the payline indicators may transform into a "$" symbol when a winning symbol combination is achieved on an active payline.

ANIMATED OR HIGHLIGHTED PAYOUTS. When a player achieves a winning combination on the mechanical reels 58*a-c*, the value of the associated payout may be displayed on the transmissive display 54 in the location of the symbol combination. The payout value may be highlighted and animated so that the player understands the payout value that he or she has achieved based on that winning symbol combination. In addition, when the player's credit meter is also located on the main display, the payout value may move across the screen towards the credit meter and intersect the credit meter at the same time the credit meter increases by the value of the player's payout. Thus, the transmissive display may provide an animation of the present winnings being deposited into the player's account or credits meter. In addition, the transmissive display 54 may show the basic mathematical addition function showing the sum of the value of the payout plus the existing value in the credit meter to show the new value that the player has in the machine, as expressed by the credit meter.

ANIMATED OR HIGHLIGHTED REEL STOPS. As the mechanical reels 58*a-c* spin and stop, the player may visualize that certain symbol combinations on active paylines are positive and may lead to a winning outcome if the final spinning reel (or reels) provides a certain symbol when it stops. The transmissive display 54 may provide added anticipation and excitement for the player when a first portion of a positive outcome is achieved on the reels by providing animation to the desirable symbols on the stopped reels. As an example, if two "7" symbols have been achieved on the first two mechanical reels 58*a-c,* and the third reel is still spinning, the transmissive display 54 may illustrate fireworks shooting outwardly from the symbol location where the two "7" symbols are located. Further, the transmissive display 54 may illustrate moving fireworks shooting from a "7" symbol on the rotating reel as that "7" symbol moves through the display region for the mechanical reels 58*a-c.* The gaming machine 10 may also use audio effects, such as voice announcing "COME ON No. 7!!!," in conjunction with the same words being displayed on the transmissive display 54.

ANIMATED OR HIGHLIGHTED SCATTER SYMBOLS. As mentioned above, scatter symbols are not required to be aligned along an active payline to produce a winning outcome. The transmissive display 54 may be used to track the movement of the scatter symbol on a mechanical reel as it proceeds through the displayed region of the mechanical reels 58*a-c.* The transmissive display 54 may also be used to highlight and/or animate a scatter symbol that is displayed within the displayed region once a reel has stopped, yielding a winning outcome for the player. The transmissive display 54 can used to display the location of the scatter symbol off the visual display area, in a manner similar to the SHOW UNDISPLAYED PORTION OF MECHANICAL REELS feature, which was described above.

MIMICKING THE MECHANICAL REELS. After a winning outcome has been achieved from the symbols on the mechanical reels 58*a-c,* the transmissive display 54 may be used to re-create and display all, or a portion, of the winning spin (perhaps in slow motion) to emphasize the positive outcome to the player.

CONGRATULATORY TEXT/ANIMATION. After a player has achieved a positive outcome, the transmissive display 54 may display alpha and/or numeric characters that communicate the positive outcome to the player in a location that overlays the display region of the mechanical reels 58*a-c.*

NUDGING SYMBOLS OUT OF THE DISPLAY REGION. The transmissive display 54 may be used to display symbols that are located outside of the display region for the mechanical reels 58*a-c.* The player may have the option to nudge a reel in one direction or another one or more times, possibly through arrow keys on the transmissive display 54 that overlie the mechanical reels 58*a-c,* until a predetermined condition (e.g., a certain number of nudges, a winning outcome, etc.) has been met. By displaying symbols located outside the display region, the player might see a scatter pay symbol (i.e., one that does not require alignment along an active payline for payout) and may move the corresponding reel in a direction to cause the scatter pay symbol to be displayed within the display region, yielding a positive outcome.

COLORING OR SHADING THE REELS. The transmissive display 54 may be used to communicate some aspect of the wagering game to the player through a coloring function or a shading function that affects the visual appearance of the underlying mechanical reels 58*a-c.* As an example, if the gaming machine 10 has had several successive winning combinations, the transmissive display 54 may progressively change to a brighter shade of red, suggesting that the gaming machine 10 is hot or on fire. The transmissive display 54 may illustrate a fire animation with words such as "This machine is on fire!!!" The color or shading may also be used to indicate the amount of the wager that the player has made. In other words, a higher wager amount will produce a brighter shade of green than a smaller wager amount.

MULTI-THEME GAMING MACHINE. Many gaming machines 10 have artwork and graphics that reflect a certain theme, such as a tropical theme. Even the mechanical reel symbols 60 are sometimes designed to follow a central theme (e.g., tropical fruits). Instead of a specific, fixed theme, the transmissive display 54 may be used to provide selectable themes. The transmissive display 54 may display the theme artwork and graphics as an overlay, including appropriate theme overlays for the mechanical reel symbols 60. The artwork and graphics may include both still images and animation. Since the transmissive display 54 provides the theme elements, it is much easier to change themes and therefore no "reel glass" is needed. This allows the gaming machines 10 to be generic, with the theme then being selectable by the players and casino operators.

ADJUSTABLE/SELECTABLE NUMBER OF REELS. The transmissive display 54 may be used to adjust the number of reels on the gaming machine 10. For example, certain portions of the transmissive display 54 may be made opaque to block out one or more of the mechanical reels 58*a-c.* The transmissive display 54 may display one or more virtual reels in place of the mechanical reels 58*a-c,* or the virtual reels may be displayed in addition to the mechanical reels 58*a-c.* The adjustments may be in the form of one or more options that are selectable by the player, or they may be selected by the gaming machine 10 (or the gaming network), for example, in response to a predetermined symbol or symbol combination on the mechanical reels 58*a-c.*

HELP OPTIONS. The transmissive display 54 may be used in conjunction with the touch screen 28 to bring up various help options and information for the player. In one implementation, the transmissive display 54 displays a candle icon that the player may touch to bring up a help screen. Other images may be used to indicate the status or condition of the gaming machine 10, for example, a malfunction in the gaming machine 10.

VIDEO CLIPS ON REEL. The transmissive display 54 may be used to play video clips on the gaming machine 10. The video clip may be a real life video clip, either live or prerecorded, or it may be an animated video clip. The clips may be related to the game play of the basic game or the bonus game of the gaming machine 10, or they may simply be congratulatory or informative in nature. They may occupy the entire display area of the transmissive display 54, or they may occupy a portion of the transmissive display 54. For example, the video clips may be played so as to appear only on a particular reel or reel symbol 60.

DOUBLE-UP OPTION. In some gaming machines 10, the player is given an option to try and double his or her winnings instead of taking the current payout. The transmissive display 54 may be used in conjunction with the touch screen 28 to provide the player with an onscreen option to double his or her winnings. For example, upon occurrence of a winning outcome on the mechanical reels 58*a-c,* the transmissive display 54 may display a double-up mechanism, such as a button 30, that the player may touch to try and double his or her winnings.

TIMER/COUNTDOWN METER. The transmissive display 54 may be used to display a timer or a countdown meter. Such a timer or countdown meter, which may be displayed off to one side of the mechanical reels 58*a-c,* is typically used to show the time remaining until a certain special event. The transmissive display 54 may also be used to display a power up or ramp up meter to show the player's eligibility for a certain special event, for example, based on the amount he or she has wagered or the time he or she has been playing. The special event may be a community-game event in which the player can participate with other players. The timer may be one that allows the player a certain amount of time to determine whether he or she wants to participate in the community event.

VOLUME CONTROL. The transmissive display 54 may be used in conjunction with the touch screen 28 to provide the player with an onscreen option to adjust the volume of the gaming machine 10. For example, the transmissive display 54 may display a knob or a slider that the player may manipulate to control the volume of the gaming machine 10.

ADMINISTRATIVE OPTIONS. The transmissive display 54 may be used to display various administrative options to the casino operators. For example, the transmissive display 54 may allow the casino operators to select certain system diagnostic tests to be run on the gaming machine 10. The results of the test may be displayed on the transmissive display 54. The transmissive display 54 may also allow the casino operators to reprogram/reconfigure various aspects of the gaming machine 10, for example, changing the payback percentage, denomination, and/or pay table of the gaming machine 10.

IN-GAME PROGRESSIVE. The transmissive display 54 may be used to display one or more progressive jackpot meters. Such a progressive jackpot meter, which may be displayed off to one side of the mechanical reels 58*a-c,* is used to show the amount that has accumulated in the progressive jackpot. The progressive may be a wide-area progressive, a casino-wide progressive (i.e., an in-casino only progressive), a bank progressive, or a standalone progressive only available at that gaming machine 10.

SECONDARY DISPLAY INTERACTION. In some gaming machines, a secondary video display may be present (e.g., as the secondary display 16) that may be any suitable video display, such as a CRT, LCD, dot matrix, LED, electro luminescent, or other type of video display. In that case, the transmissive display 54 may be operated in conjunction with the secondary display. In one example, the video images of the transmissive display 54 may interact with the video images of the secondary video display in some manner (e.g., a cause-and-effect relationship). In another example, the transmissive display 54 and the secondary display may be coordinated to present a unified image of the wagering game, with part of the wagering game shown on one display and part on the other display. An example of such a unified display may be found in commonly-assigned U.S. Pat. No. 6,254,481 entitled "Gaming Machine with Unified Image on Multiple Video Displays," issued Jul. 3, 2001, and incorporated herein by reference.

TOP BOX EVENT. In some gaming machines 10, the secondary display 16, which is usually located on top of the primary display 14, is also a mechanical display, such as mechanical dice, mechanical reels 58*a-c* (including micro-reels), and other mechanical devices. A transmissive display 54 may also be superimposed on the secondary display to cover up the secondary display, for example, until occurrence of a predetermined symbol or symbol combination on the primary display 14. The transmissive display 54 of the secondary display may be a separate device from the transmissive display 54 of the primary display 14, or a single transmissive display 54 may be superimposed over both primary and secondary displays.

HIGH SCORES/LEADER BOARD. The transmissive display 54 may be used to display a high-scores board. Such a high-scores board, which may be displayed off to one side of the mechanical reels 58*a-c,* is used to show the names of the 10 all-time highest scoring players on the gaming machine 10. Similarly, where the gaming machine 10 is part of a multi-machine competition (or collaboration) the transmissive display 54 may be used to show the current leaders in the session.

PICK A SCATTER/WILD. The transmissive display 54 may be used in conjunction with the touch screen 28 to allow the player to pick or buy a scatter pay. For example, the transmissive display 54 may display a graphical overlay of the mechanical reels 58*a-c.* The player may then select a certain reel to be a scatter pay, and the transmissive display 54 will highlight or otherwise indicate that reel as a scatter pay. In some embodiments, the player may also select a particular reel symbol 60 via the transmissive overlay. If that reel symbol 60 is landed, then the player is awarded the value of that symbol. The player may also pick or buy a symbol to be a wild symbol. The selected symbol is then evaluated as a wild symbol for that round of the wagering game. In general, the transmissive display 54 may be used in conjunction with the touch screen 28 to allow the player to pick or buy a game modification feature that is visually enhanced. For example, the symbol that is selected to be a wild symbol may have a small watermark superimposed on it to indicate that it is now a wild symbol.

SCRATCH-OFF ENHANCEMENTS. The transmissive display 54 may be used in conjunction with the touch screen 28 to implement scratch-off enhancements. For example, the transmissive display 54 may overlay certain reel symbols 60 with a scratch-off icon. If these symbols appear on an active payline, the player may scratch the scratch-off icon to reveal an enhancement to the symbols (e.g., a 2× multiplier).

Group 5. Enhancing Bonus Features

In Group 5, the transmissive display 54 may be used to create or award extra features with respect to a bonus game by adding video elements over the mechanical reels 58*a-c.* Following are examples of Group 5 features.

COLLECT SYMBOLS. In certain types of wagering games, there are bonuses that may be awarded for collecting certain symbols during a gaming session. These wagering games typically entail several consecutive wagers being made at the gaming machines 10. The transmissive display 54 may be used to illustrate certain desirable symbols or symbol combinations that are achieved during the gaming session. The player may be awarded a bonus award if he or she collects a predetermined number of symbols or symbol combinations.

VARIABLE MULTIPLIER. In certain wagering games, a player may be awarded free spins (or discounted spins) on the mechanical reels 58*a-c*. Often times, those free spins have an associated multiplier such that if the player achieves a winning outcome, the payout associated with that winning outcome is multiplied by a certain value. The transmissive display 54 allows for a multiplier in a free spin (or discounted spin) to be displayed as the player is conducting the free spin. The transmissive display 54 may also randomly cycle through a plurality of possible multipliers as the free spin is occurring and stop on one of the multipliers so that the player views the moving symbols on the mechanical reels 58*a-c* and the changing multiplier on the transmissive display 54, both of which will have an impact on the payout from the free spin. Alternatively, the transmissive display 54 may illustrate and highlight consecutively increasing multipliers that apply to each successive free spin resulting in a winning outcome.

ANIMATED CHARACTERS APPEARING TO CHANGE OUTCOME. The transmissive display 54 may be used to provide the appearance that an animated character or object changes the existing outcome to a better outcome for the player. For example, if the player has a non-winning outcome, then an animated character (e.g., a fairy) may appear across the transmissive display 54 and cause one of the mechanical reels 58*a-c* to appear as though one of its symbols has moved to the active payline that would achieve a positive result. Alternatively, the animated character may simply appear on the transmissive display 54 and inform the player of the poor outcome, but instruct the player that good fortune has arrived by adding a certain credit amount (e.g., 10 credits) to the player's credit meter.

MYSTERY AWARD. The transmissive display 54 may be used to illustrate a mystery award (e.g., a credit amount, a bonus feature, etc.) that may be randomly awarded to the player. For example, the gaming machine 10 may have a second random-number generator dedicated solely to a mystery award. The player is aware of the mystery award because its existence is displayed on the transmissive display 54, perhaps through a moving mystery award symbol that passes through the mechanical display region. If the player has achieved the mystery award, the transmissive display 54 may be used to inform the player that he or she won the mystery award. In other words, the transmissive display 54 is providing a second wager game that, while overlying the main wagering game involving the mechanical reels 58*a-c*, is played in a manner separate and distinct from the main wagering game involving the mechanical reels 58*a-c*.

FREE SPIN ON VIDEO SLOT. The transmissive display 54 may also be used to play a free spin on the video reels (or other bonus game) after such an event has been triggered by the underlying mechanical reels 58*a-c*. For example, a transmissive display 54 may blackout (i.e., darken) the underlying mechanical reels 58*a-c* and may display a plurality of video reels, which are rotated to present the player with a randomly selected outcome.

MODIFIED PAY TABLE. A bonus event may be triggered that allows the player to have a free spin of the mechanical reels 58*a-c* with an increased-value (i.e., modified) pay table. The transmissive display 54 may then be used to display the modified pay table to the player before and during the free spin. Alternatively, the transmissive display 54 may provide for a plurality of different pay tables, and the player may select the pay table to be applied during the free spin.

MODIFIED RULES FOR BONUS GAME. The transmissive display 54 may be used to inform the player of a modification or alteration to the rules that are used for a wagering game, such as a bonus game. As an example, a free spin of the mechanical reels 58*a-c* may be provided to the player and a certain symbol, such as a cherry symbol, may be used as a "wild" symbol for only the free spin. The transmissive display 54 may highlight the cherry symbol on the underlying mechanical reels 58*a-c* (e.g., placing stars around it) and inform the player that the cherry symbol will be a wild symbol for the follow-up free spin.

MATRIX AWARD TABLE. A bonus game may be configured such that, in a wagering game with three mechanical reels 58*a-c*, only the first and third mechanical reels 58*a* and 58*c* are used and the second mechanical reel 58*b* is not used (i.e., blocked out). A matrix is then displayed on the transmissive display 54 where the X-coordinates in the matrix include a plurality of different reel symbols 60 for the first mechanical reel 58*a* and the Y-coordinates in the matrix include another plurality of different reel symbols 60 for the third mechanical reel 58*c*. The center portion of the matrix lists an award for each combination of symbols on the first and third mechanical reels 58*a-c*. The player is then given a chance to spin the mechanical reels 58*a* and 58*c* and the symbol combinations on the first and third mechanical reels 58*a* and 58*c* dictate a payout pursuant to the award in the matrix. More specifically, the intersection of the X-coordinate designated by the symbol on the first mechanical reel 58*a* and the Y-coordinate designated by the symbol on the third mechanical reel 58*c* determines the award yielded by the matrix. Accordingly, the transmissive display 54 may display a matrix that dictates the payout of the game, while the mechanical reels 58*a* and 58*c* are spinning and stopping.

BONUS REEL INDICATOR. The mechanical reels 58*a-c* may include a bonus reel having a plurality of different beneficial symbols, such as a plurality of multipliers (e.g., 2×, 4×, 3×, 1×, 8×, etc.) that are applied to any winning combination that occurs on the primary mechanical reels 58*a-c*. The displayed region for the mechanical reels 58*a-c* may be constructed such that three symbol locations appear in a vertical direction. An outcome indicator for the bonus reel may take the form of a video arrow on the transmissive display 54 that moves among the three possible symbol locations for the bonus reel. In addition to the bonus reel spinning, causing its symbols to move through the display region, the indicator moves between the three vertical symbol locations. Thus, the outcome from the bonus reel is dictated by the moving bonus reel and the moving video indicator on the transmissive display 54.

CATCHING CREDITS. After a winning outcome has been achieved by the mechanical reels 58*a-c*, the transmissive display 54 may illustrate credits in the form of coins being scattered outwardly from the winning symbol combinations and falling downwardly towards the bottom of the transmissive display 54. Buckets, which are graphically illustrated on the transmissive display 54, may move back and forth collecting the coins as they fall so as to indicate to the player the amount that he or she has won in the wagering game. The coins may be shown to deflect off certain mechanical reel symbols 60 (e.g., deflector symbols) and to be swallowed up by other mechanical reel symbols 60 (e.g., receptor symbols), thus potentially missing the buckets. Alternatively, instead of virtual coins, the transmissive display 54 may display balls bouncing off the various mechanical reel symbols 60, each ball representing a certain credit amount. Additionally, the transmissive display 54 may allow the player to control the movement of one of the buckets to collect the coins or balls as they fall. While this aspect requires some skill of the player, which is as typically not allowed in most gaming establishments, the remaining buckets may compensate for a low skill or high skill player. Thus, regardless of the skill level of the player moving the bucket, the payout is still the same.

REVEAL BONUS. The transmissive display 54 may be used to hide and subsequently reveal a mechanical feature on the primary or secondary display, such as dice. The mechanical feature is revealed only upon occurrence of a predetermined symbol or symbol combination on the mechanical reels 58*a-c*. For example, the transmissive display 54 may be used as an opaque door that is open only upon occurrence of the predetermined symbol or symbol combination.

TRAIL GAMES. The transmissive display 54 may be used to play a secondary persistent state game (i.e., one that extends over a gaming session or several gaming sessions) involving a trail or a map contemporaneously with the mechanical reels 58*a-c*. The persistent state game may be part of the basic game or a bonus game. The trail game may be a board game based on a theme, such as the Monopoly™ board game theme. The transmissive display 54 is used to display the trail or map, usually surrounding the mechanical reels 58*a-c*, and the player is taken to different parts of the trail or map as indicated by, for example, the outcome of the mechanical reels 58*a-c* or some other event (e.g., a spin of the dice). In one embodiment, each time the player achieves a winning outcome on the mechanical reels 58*a-c*, an avatar, game piece, or space identifier is moved along the trail or map toward some predetermined objective. Optionally, the player may collect different objects on the trail or map, each object having a predetermined value. When the player lands on a certain symbol on the mechanical reels 58*a-c*, that symbol increases in value on the trail or map. If the player decides to terminate the gaming session, the objects he or she has collected and the increased values thereof may be saved by the gaming machine 10 or the gaming network for subsequent retrieval. The transmissive display 54 may be used to display to the player the game status information that is being saved along with the identity of the player. Similarly, when the player resumes playing, the transmissive display 54 may be used to display to the player the game status information that has been retrieved.

KENO OVER REELS. The transmissive display 54 may be used in conjunction with the touch screen 28 to play an entirely different game, such as Keno, poker, and the like. For example, upon occurrence of a predetermined symbol or symbol combination on the mechanical reels 58*a-c*, the transmissive display 54 displays the Keno, poker, or other games above or below the mechanical reels 58*a-c*. The player may then play the Keno, poker, or other games by touching the appropriate area on the touch screen 28.

CONSUMING SYMBOLS. The transmissive display 54 may be used to show an object eating the symbols on the mechanical reels 58*a-c*. For example, upon occurrence of a predetermined symbol or symbol combination on the mechanical reels 58*a-c*, the transmissive display 54 may show a character, such as Pac-man, that eats one or more randomly selected symbols 60 on the mechanical reels 58*a-c* and leaves behind a credit amount in place of the symbols 60.

BONUS REEL PICK OPTIONS. One type of bonus game that is popular among players is a player-selection game in which the player is presented with an array of picks. Each pick, when selected, reveals either a prize, typically a credit amount, or a play-termination symbol that terminates the bonus game. Instead of a credit amount, the transmissive display 54 may display a bonus reel whenever a prize is selected. The credit amount that is awarded to the player may then be determined by the outcome of the bonus reel. The player-selection game may be conducted on the secondary display 16, or it may be conducted on the transmissive display 54 along with the bonus reel. In either case, the additional level of play adds further excitement to the gaming experience.

CLASS 2 GAMES. The transmissive display 54 may be used to play Bingo and other Class 2 games, as defined by the Indian Gaming Regulation Act. In one embodiment, the transmissive display 54 may display a bingo card upon occurrence of a predetermined symbol or symbol combination on the mechanical reels 58*a-c*. The bingo card may be located, for example, off to one side of the mechanical reels 58*a-c* or any other suitable location. The mechanical reels 58*a-c* are then used to provide (i.e., call out) the bingo letters and numbers in a manner known to those having ordinary skill in the art.

YAHTZEE™. The transmissive display 54 may be used in conjunction with the touch screen 28 to play dice games, such as Yahtzee™. In one embodiment, the transmissive display 54 may display a pair of dice upon occurrence of a predetermined symbol or symbol combination on the mechanical reels 58*a-c*. The player may roll the dice by touching the appropriate area (e.g., a button 30) on the transmissive display 54. The rules of play for Yahtzee™ are well known to those having ordinary skill in the art and will therefore not be described here. The Yahtzee™ game may be triggered by a certain symbol combination that is present in the basic wagering game.

ACCEPT OR REJECT. In some gaming machines 10, the player is given an option to try and increase his or her winnings instead of taking the current payout. The transmissive display 54 may be used in conjunction with the touch screen 28 to provide the player with an onscreen option to either take his or her current winnings or try for a higher payout. For example, upon occurrence of a winning outcome on the mechanical reels 58*a-c*, the transmissive display 54 may display an accept-or-reject option, via a button 30, that the player may press to try and increase his or her winnings.

REVERSE TETRIS™. The transmissive display 54 may be used to implement a game where the reel symbols 60 in a winning payline are moved up and stacked, much like a Tetris™ game in reverse. The combining of certain symbols in the stack, for example, three "bells," enhances the player's winnings. The transmissive display 54 may be used to visualize the upward movement of the reel symbols 60 and the subsequent enhancement of the payout.

BATTLING SYMBOLS. The transmissive display 54 may be used to simulate two or more reel symbols 60 engaged in battle. For example, the video transmissive display 54 may show two pirate ship symbols firing canons at one another. The outcome of the battle may be used to determine the basic-game payout (if the symbols appear on adjacent reels 58*a-c*) or bonus award given to the player.

PICK FREE-SPIN FEATURE. In some gaming machines 10, the player may be awarded free spins of the mechanical reels 58*a-c* upon occurrence of a predetermined symbol or symbol combination on the mechanical reels 58*a-c*. The transmissive display 54 may then be used to allow the player to pick certain features associated with the free spins, for example, the number of free spins, a multiplier that may or may not be connected to the free spins, the function of one or more reel symbols used in the free spins (e.g., a wild symbol, a scatter pay symbol, etc.). In one example, the transmissive display 54 may display a set of pick options from which the player may pick, with the selected pick option revealing the free-spin feature (e.g., the number of free spins). In another example, the transmissive display 54 may display a virtual bonus reel that the player may spin. The free-spin feature awarded to the player is then determined by the result of the virtual reel.

INCREASING VALUE OF BONUS SYMBOL. In some gaming machines 10, the bonus game involves the player collecting various symbols, each symbol resulting in a certain number of credits to the player. The value of certain symbols, however, may be worth double, triple, or more, of their usual value if the player collects the symbols after a predetermined event. The transmissive display 54 may be used to graphically illustrate the increase in value of these symbols.

Use of the Transmissive Display In Regions Outside of the Game-Play Region

FIGS. 4*a* and 4*b* illustrate the three mechanical reels 58*a,* 58*b,* and 58*c* being viewed through the transmissive display 54. In theses side views of FIGS. 4*a* and 4*b*, it can be seen that the transmissive display 54 has regions below and above the mechanical reels 58*a,* 58*b,* and 58*c*. Furthermore, from FIGS. 5*a*-5*d,* it can be seen that the transmissive display 54 covers not only the game-play region that includes the three mechanical reels 58*a,* 58*b,* and 58*c,* but it also covers additional regions above, below, and between the three mechanical reels 58*a,* 58*b,* and 58*c,* and to the left and right of the mechanical reels 58*a* and 58*c,* respectively.

Many of the various game options in Groups 1-5, described above, provide for the use of images on the transmissive display 54 outside of the game-play region. The player instructions 70 in FIG. 5*a*, the "INSERT COINS" image in FIG. 5*b,* the secondary game including the dice 84 in FIG. 5*d*, and the additional reel 80 in FIG. 5*d* are examples of the transmissive display 54 being used to provide images outside of the game-play region of the mechanical reels 58*a,* 58*b* 58*c*.

The various options described below in Groups 6-9 focus on other designs and game play configurations that utilize images outside of the game-play region defined by the mechanical reels 58*a,* 58*b,* and 58*c*. Like Groups 1-5 mentioned above, many of the options in Groups 6-9 may overlap among various groups, but are listed under a specific group for the sake of organization. It should also be noted that not all of the options in Groups 6-9 require a transmissive display 54 to accomplish the result of displaying various images (e.g., messages, secondary games, information, symbols, etc.) outside the game-play region that includes the three mechanical reels 58*a,* 58*b,* and 58*c*. Rather, the region outside the game-play region may include a single standard display or multiple standard displays (e.g., LCDS, OLEDS) that are not transmissive.

Group 6: Indicator of Condition Or Status of Game Play

INDICATOR OF THE TRIGGERING OF PROGRESSIVE AWARD OR BONUS AWARD. The transmissive display 54 can provide a visual indication regarding the award of a progressive game. For example, the transmissive display 54 can provide color changes to indicate that a mystery progressive award is about to be awarded (e.g., various hues of yellows, oranges, and reds, ultimately leading to a brilliant red at the time of the triggering). Or, the transmissive display 54 can visually illustrate the temporal proximity of the progressive game award by illustrating lava rising in a volcano image outside of the game-play region defined by the mechanical reels 58*a,* 58*b,* and 58*c*. When the progressive award is eventually triggered, the volcano is illustrated sending the lava into the air and, perhaps, indicating the monetary amounts of the award. Because a progressive game may include multiple levels, multiple volcanoes could be illustrated on the transmissive display 54, each of which provides information about the temporal proximity of the triggering of a specific progressive award. In addition to the progressive game, the transmissive display 54 can display the near triggering of other events, such as when a bonus game is about to be triggered. For example, when the mechanical reels 58*a* and 58*b* are stopped with a near bonus-triggering symbol combination and the mechanical reel 58*c* is still rotating, the transmissive display 54 can indicate with colors or other images how close the player is to achieving the bonus game as the mechanical reel 58*c* slowly comes to a stop.

ACCUMULATION INDICATOR. In some basic games, one of the goals is to accumulate certain symbols or certain symbol combinations over a series of spins of the mechanical reels 58*a,* 58*b,* 58*c*. The transmissive display 54 can provide a visual indication of how many of these accumulated elements have been achieved, and how many more are needed to result in an award due to the accumulated elements. The visual indication may be provided by color changes or other changing animation.

STATUS OF SYMBOLS. In some games, the status of a symbol may change from spin to spin. For example, a symbol may change from a normal symbol, to a "WILD" symbol, to an expanding "WILD" symbol (covering multiple symbol locations) after it appears a predefined number of times. In a region of the transmissive display 54 outside of the game-play region defined by the mechanical reels 58*a,* 58*b,* and 58*c,* each alterable symbol may be shown along with its current status.

STATUS OF REELS THAT ARE BEING PLAYED. In some games, the player may be able to select an additional reel that can be played in exchange for an additional wager. As an example, FIG. 5*d* illustrates a fourth reel 80 that has been added to a wagering game via the transmissive display 54. To the extent that an additional wager is needed, the transmissive display 54 can include the statement "Purchased" or "Not Purchased" above each reel to indicate to the player which reels are being played during that spin.

Figure 6A:
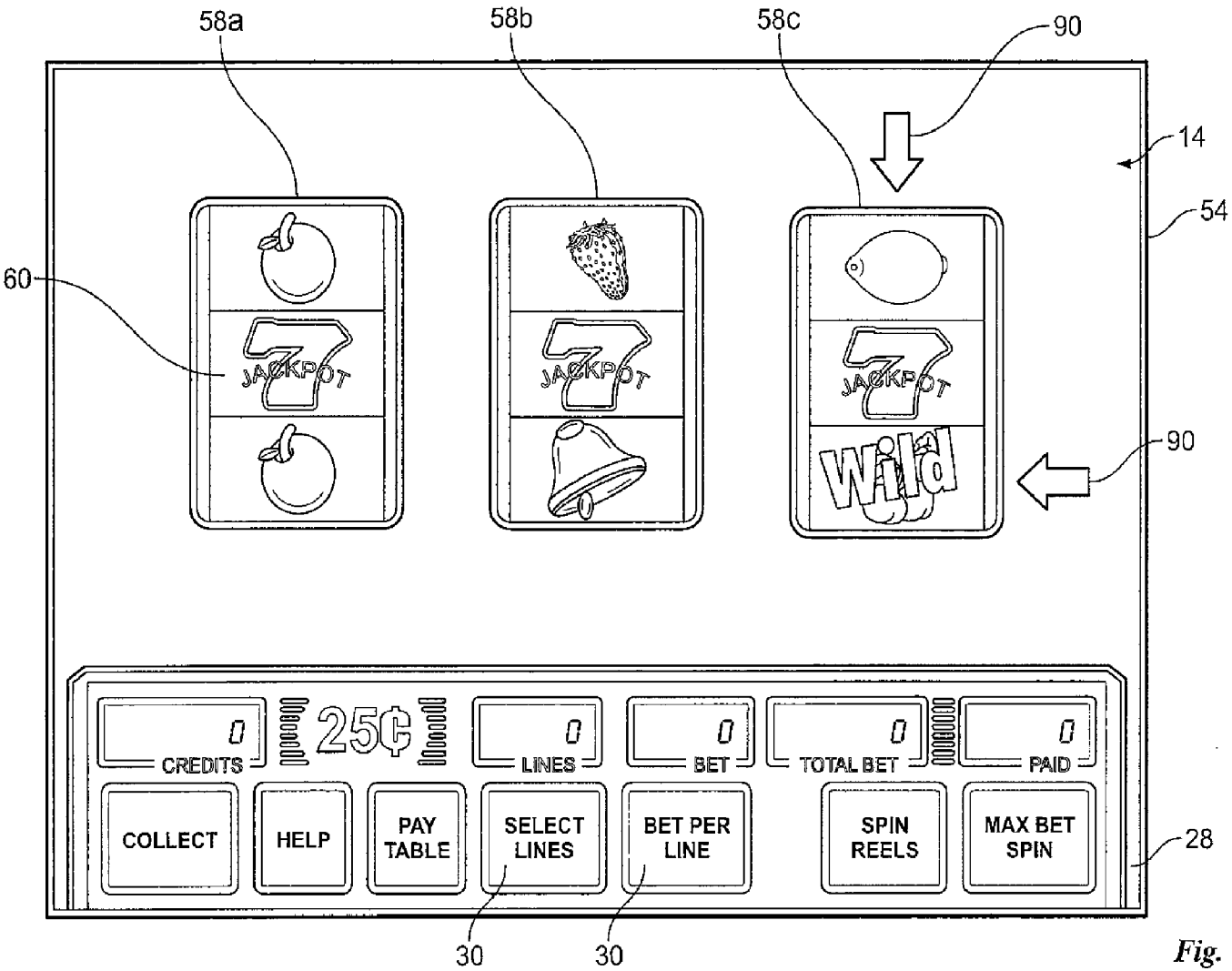
FIGS. 6*a*-6*e* illustrate examples of various display game-play functions, designs, and configurations that may be specifically located on the top, bottom, or sides of the game-play region.

INDICATOR OF SYMBOL LOCATION. The transmissive display 54 can be used to indicate the specific location in the array of symbols. For example, FIG. 6*a* illustrates a pair of arrows 90 on the transmissive display 54 that are used to indicate a symbol location ($3^{rd}$ reel 58*c,* the lowermost symbol location) in which a normal CHERRY symbols is changed to a WILD symbol. The pair of arrows 90 can move outside the periphery of the reels 58 to indicate any symbol location for various game-play purposes.

Figure 6B:
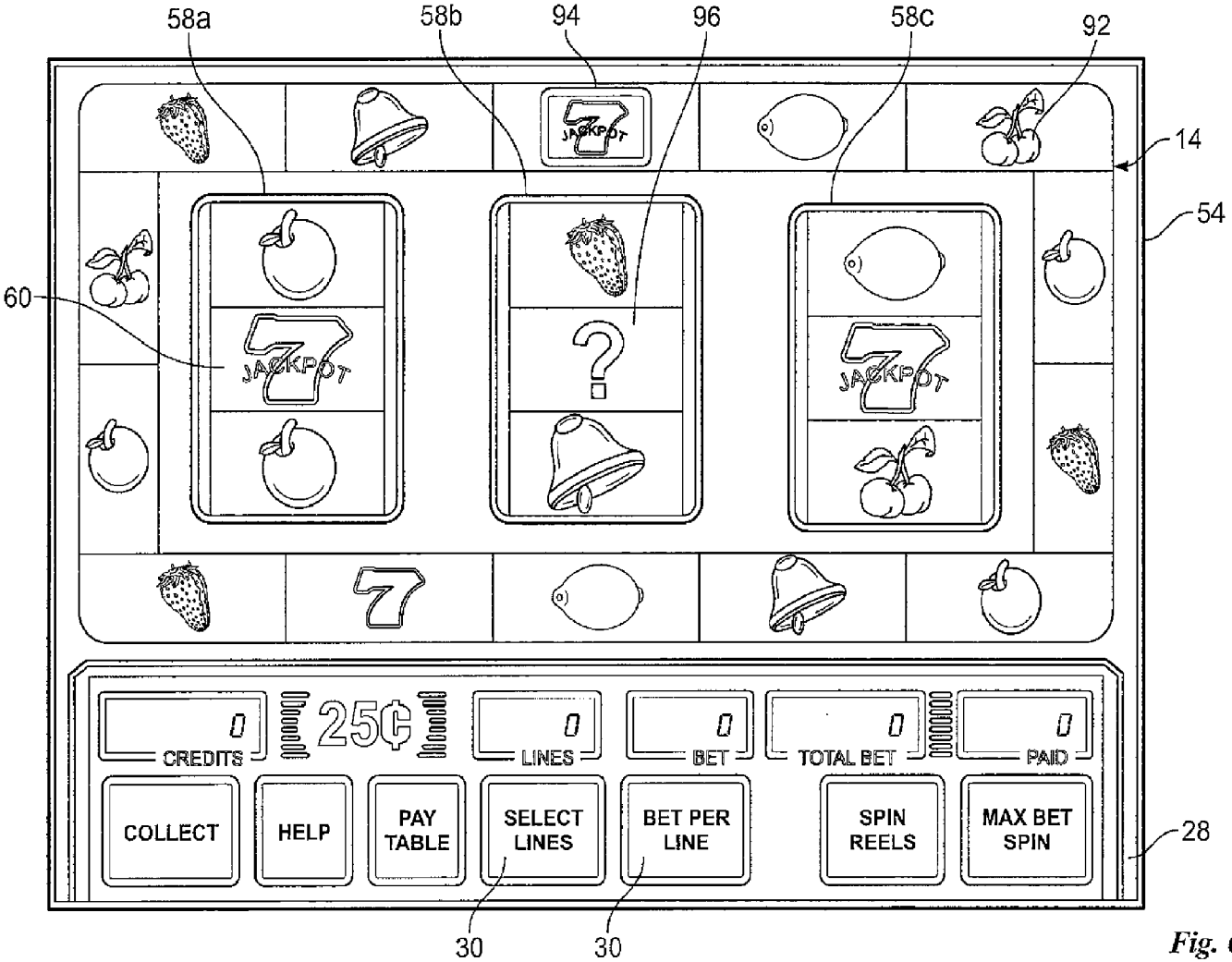

INDICATOR OF SYMBOL. The transmissive display 54 can be used to indicate a type of symbol that is to be added to the symbols on the mechanical reels 58*a,* 58*b,* 58*c*. For example, FIG. 6*b* illustrates secondary symbols 92 located around the reels 58. The secondary symbols 92 move in a clockwise or counterclockwise direction, and ultimately stop with one of the secondary symbols 92 located within the box 94. The symbol 92 within the box 94 then applies to any symbol location on the mechanical reels 58*a,* 58*b,* 58*c* in which a QUESTION MARK symbol 96 is present. In this case, a SEVEN symbol within the box 94 is used to create a combination of three "SEVEN" symbols.

INDICATOR OF NEAR WINNING SYMBOL COMBINATION. The transmissive display 54 can display the initial symbols in a winning symbol combination that appear along an active payline. For example, in FIG. 6*a*, the two SEVEN symbols in the middle row of the first two mechanical reels 58*a,* 58*b* can be displayed with some type of emphasis or highlighting above the first two mechanical reels 58*a,* 58*b* on the transmissive display 54, while the third mechanical reel 58*c* is still spinning. Hence, the player would be able to visualize a near winning symbol combination, thereby experiencing a heightened level of anticipation.

Group 7: Display For Secondary Games

Figure 6C:
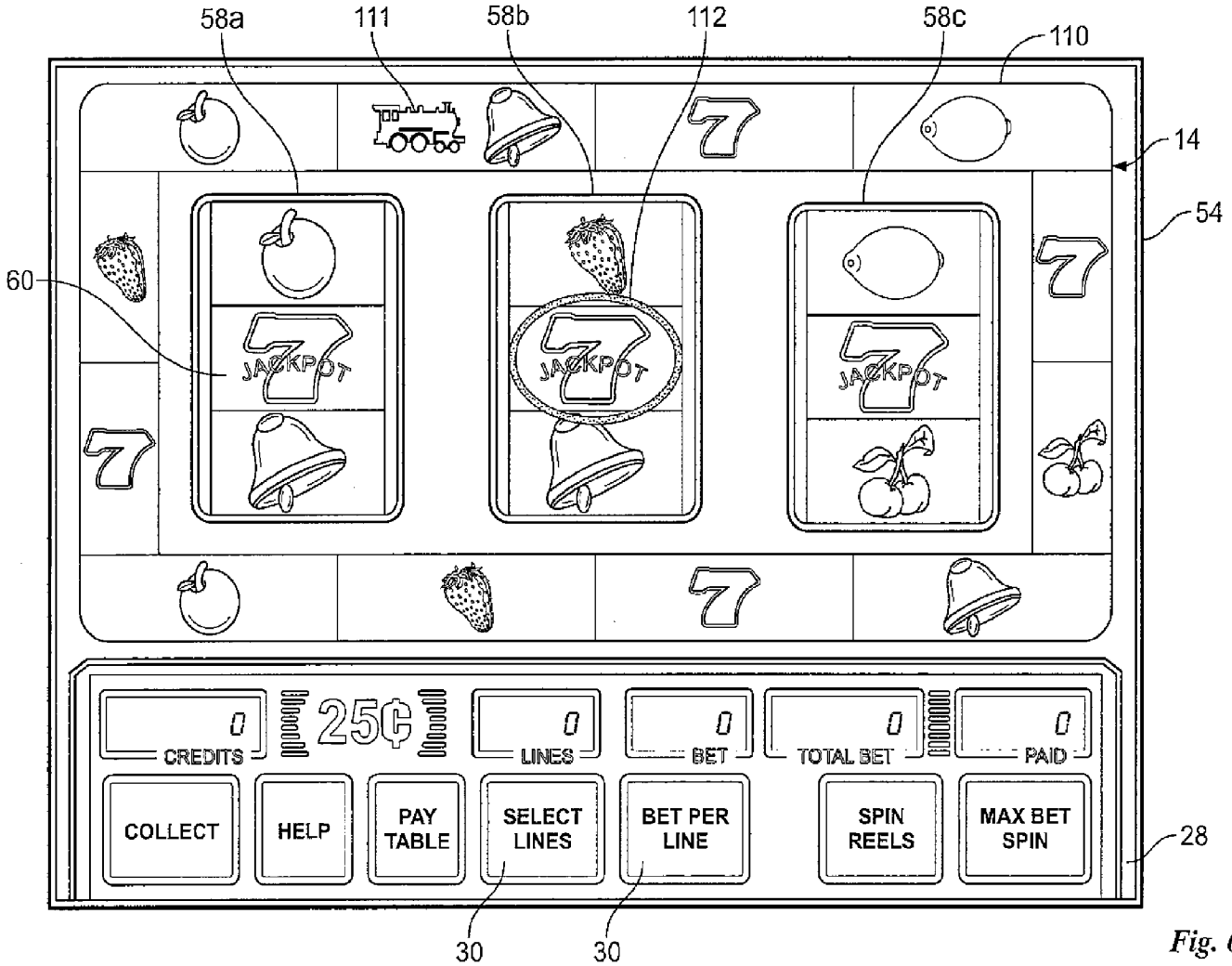

BOARD GAME AROUND THE REELS. The transmissive display 54 can provide a secondary game involving symbols located around the mechanical reels 58*a*, 58*b*, 58*c*. In one game, as shown in FIG. 6*c*, a path 110 around the transmissive display 54 includes a plurality of different locations. A movable path element 111, which is shown as a train engine, moves one space with each spin of the reels. A reel-symbol indicator 112 indicates a symbol location for each spin. The reel-symbol indicator 112 can be stationary or movable. After each spin, if the symbol within the reel-symbol indicator 112 matches the symbol along the path 110 as indicated by the movable path element 111, then the player wins a secondary award. As an alternative, the movable path element 111 may move a certain number spaces along the path 110 as dictated by the symbol within the reel-symbol indicator 112 (e.g., a BELL symbol is 1 space, an ORANGE symbol is 2 spaces, a SEVEN symbol is 7 spaces, etc). After each spin, if the symbol within the reel-symbol indicator 112 matches the symbol along the path 110 as indicated by the movable path element 111, then the player wins a secondary award. Or, in this alternative, the path 110 may be more of a common board game, like MONOPOLY®, in which the player's movable path element 111 is a common MONOPOLY® game piece. The common MONOPOLY® game piece would indicate outcomes corresponding to the properties on which it lands.

MATCHING SYMBOL STRINGS. The transmissive display 54 could include the game path 110, like the one shown in FIG. 6*c*, that is populated with symbols based on the symbols located within the reel-symbol indicator 112, which can be stationary or movable. The population at locations along the game path 110 may occur in a random order or in a sequential order. If adjacent symbols within the game path 110 (e.g., two or three symbols) are the same, then the player may be awarded an additional bonus award.

ROTATING WHEEL. The transmissive display 54 could include a larger wheel around the mechanical reels 58*a*, 58*b*, 58*c* in a manner that is somewhat similar in shape as the path 110 in FIG. 6*c*. The larger wheel may spin each time the mechanical reels 58*a*, 58*b*, 58*c* are spun, or only in response to certain conditions being met in the basic game with the mechanical reels 58*a*, 58*b*, 58*c*. The larger wheel may include spaces with credits awards and/or other award types such as multipliers or free spins, which the player may apply in the basic game. An indicator on the transmissive display 54, which may be at the very top position on the large wheel, would indicate what outcome on the large wheel is awarded to the player. Or, because the transmissive display 54 provides flexibility in the display of the elements, the indicator could move in a direction that is opposite to be direction that the larger reel spins. The color of the indicator may change such that the matching of the color of the indicator with the color of the space may provide a further award.

RACE TRACK. The transmissive display 54 could include a race track in which a player's game play element, such as a horse or a car, moves around the race track outside of the mechanical reels 58*a*, 58*b*, 58*c*. The movement can be based on certain symbols or symbol combinations that appear on the mechanical reels 58*a*, 58*b*, 58*c*. The race that is displayed on the transmissive display 54 can be an individual race involving only the player at the gaming machine, or it could be a competitive game involving players from other gaming machines.

UNLOCKING SECONDARY REELS. The transmissive display 54 could include three single-symbol reels, one above each of the mechanical reels 58*a*, 58*b*, 58*c*. In response to a certain triggering condition, such as the appearance of a scatter symbol, the three single-symbol reels (i.e., reels that display only a single symbol at a time) are unlocked and begin to spin. The player can be provided with an additional award in response to a winning symbol combination on the unlocked single-symbol reels.

UNLOCKING HIDDEN MECHANICAL FEATURE OR DEVICE. The gaming machine may include mechanical devices, such as dice or a physical wheel, located above or below mechanical reels 58*a*, 58*b*, 58*c*. The transmissive display 54 can be used to hide this mechanical device by darkening the region in front of the mechanical device relative to the player's line of sight. In response to some type of triggering event, the transmissive display 54 then provides a view into the mechanical device or feature so that the player can see the resulting outcome of the mechanical feature. The mechanical device or feature may enhance the award of the basic game as dictated by the mechanical reels 58*a*, 58*b*, 58*c*, or may provide a separate award.

KENO OR POKER GAME. As described above, the transmissive display 54 may be used in conjunction with the touch screen 28 to play an entirely different game, such as Keno, poker, and the like. For example, the transmissive display 54 may display Keno, poker, or other games above or below the mechanical reels 58*a*-58*c*. The player may then play Keno, poker, or other games by touching the appropriate area on the touch screen 28.

Figure 6D:
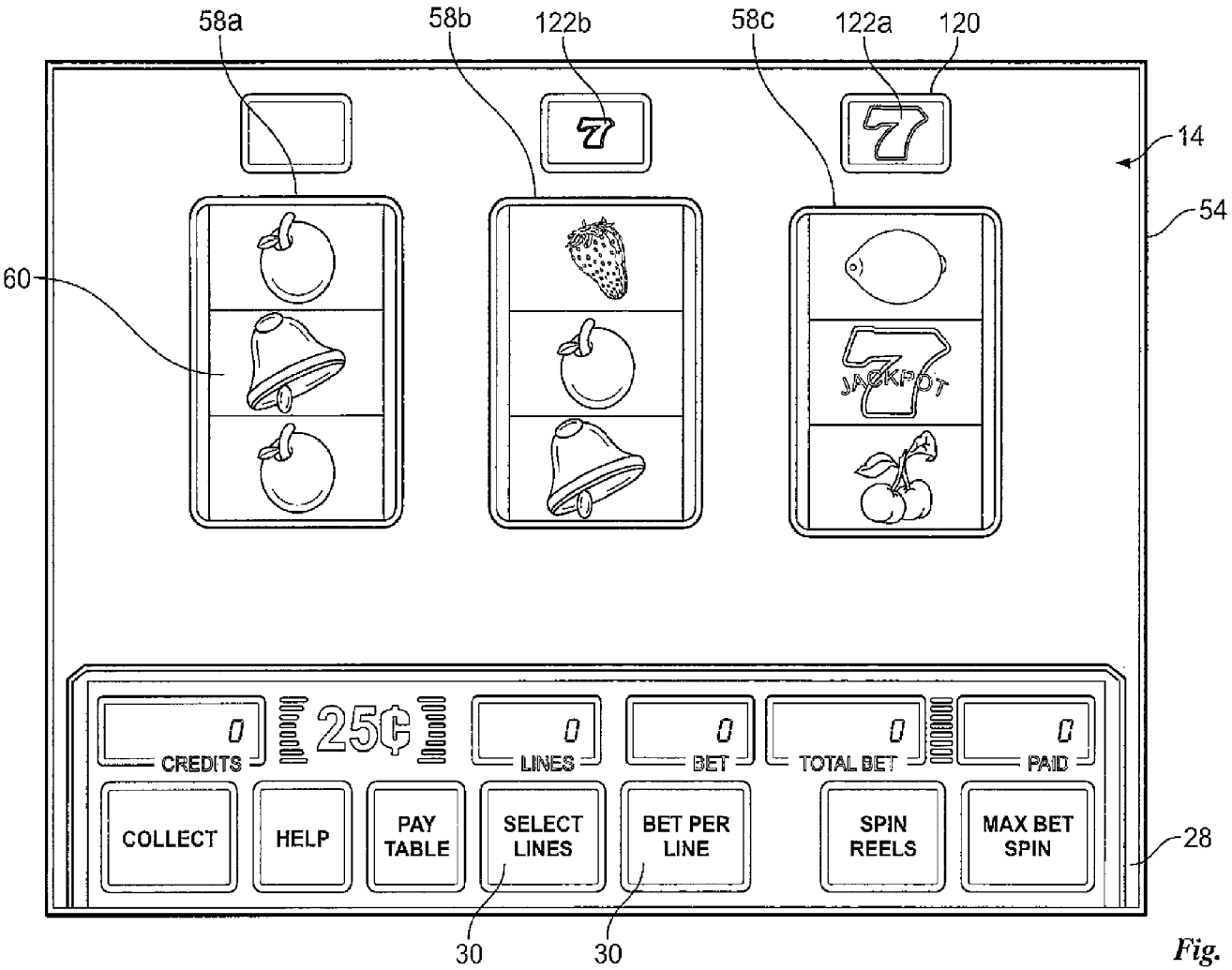

PERSISTENT STATE GAME. The transmissive display 54 may be used to display a persistent state game, such as the one shown in FIG. 6*d*. The transmissive display 54 includes three display regions 120 for recording the current state of a desirable symbol, which in this case is the SEVEN symbol. When a SEVEN symbol appears along the middle payline, that SEVEN symbol is transferred upwardly to the corresponding display region 120 where it will remain for a plurality of spins. As an example, each time that a SEVEN symbol is transferred upwardly, it can remain in that display region 120 for three spins. Initially, it appears as a large SEVEN symbol 122*a*. After each of the next three spins, it progressively gets smaller in size (and/or changes color), like the smaller SEVEN symbol 122*b*, to inform the player that it will remain in that display region 120 for only one or two more spins. Ultimately, it completely vanishes from the display region 120. If, on the other hand, the player is able to collect three SEVEN symbols in the three display regions 120, he or she achieves an award.

SYMBOL TRANSFER GAME. The transmissive display 54 may be used to display a secondary game that moves symbols from the mechanical reels 58*a*-58*c* onto certain display regions, like the display regions 120 in FIG. 6*d*. In particular, a symbol in the basic game may include a specific mark, such as a watermark, which causes that symbol to be transferred to the display region. Symbols from each reel 58*a*, 58*b*, 58*c* are only transferred to a display region associated with that reel. If such a transfer of symbols results in a winning symbol combination in the display regions, the player is provided with an additional award. Unlike the persistent state game in FIG. 6*d*, the display regions are reset after each spin. Alternatively, the persistent state feature could be added, allowing a transferred symbol to remain in the associated display region for a certain number of spins, or until overridden by another symbol on that reel containing the specified mark in a subsequent spin.

SYMBOL CHOOSING GAME. The transmissive display 54 can also be used to display certain symbols that appear on the mechanical reels 58*a*, 58*b*, 58*c*. The player then subsequently selects one or more of the symbols, which then reveals a hidden award under that symbol. For example, a certain winning symbol combination may have a variable award, and may trigger those winning symbols to be displayed on the transmissive display 54 below the mechanical reels 58*a*, 58*b*, 58*c*. The player then chooses two symbols, eliminating those symbols from contention. The last of the three symbols then reveals the player's award for that winning symbol combination. Or, the player receives an award in the basic game, and the player's selection from those symbols in the transmissive display 54 (and the touch screen 28) results in an additional award.

DISPLAYING SYMBOL-BEARING REELS. The transmissive display 54 can also be used to display an entirely new set of reels (possibly with new symbols) in response to a certain triggering event from the outcome on the mechanical reels 58*a*, 58*b*, 58*c*. The new set of video reels on the region outside the game-play region defined by the mechanical reels 58*a*, 58*b*, 58*c* would include a unique pay table that is different from the pay table associated with the mechanical reels 58*a*, 58*b*, 58*c*. As one example, one or more of the mechanical reels 58*a*, 58*b*, 58*c* may include a single symbol that looks similar to a plurality of mini-reels. When a certain number of mini-reel symbols are displayed anywhere on the mechanical reels 58*a*, 58*b*, 58*c*, the new set of reels appears on the transmissive display 54. The player may be able to win credits, bonus games, or progressive awards by the new set of reels on the transmissive display 54.

Group 8: Modifying the Play of the Basic Game

DISPLAYING ADDITIONAL SYMBOL-BEARING REELS. As described above, the transmissive display 54 can provide various video reels that are used in conjunction with the mechanical reels 58*a*, 58*b*, 58*c*. The video reels can be located on the left side of the first reel 58*a* and/or on the right side of the third reel 58*c*. They can also be located between the mechanical reels 58*a*, 58*b*, 58*c*. The video reels can be used to display symbols that are used in conjunction with the symbols on the mechanical reels 58*a*, 58*b*, 58*c*. The player may pay for the additional video reel(s) on the transmissive display 54, or it may become activated in response to a triggering condition.

Figure 6E:
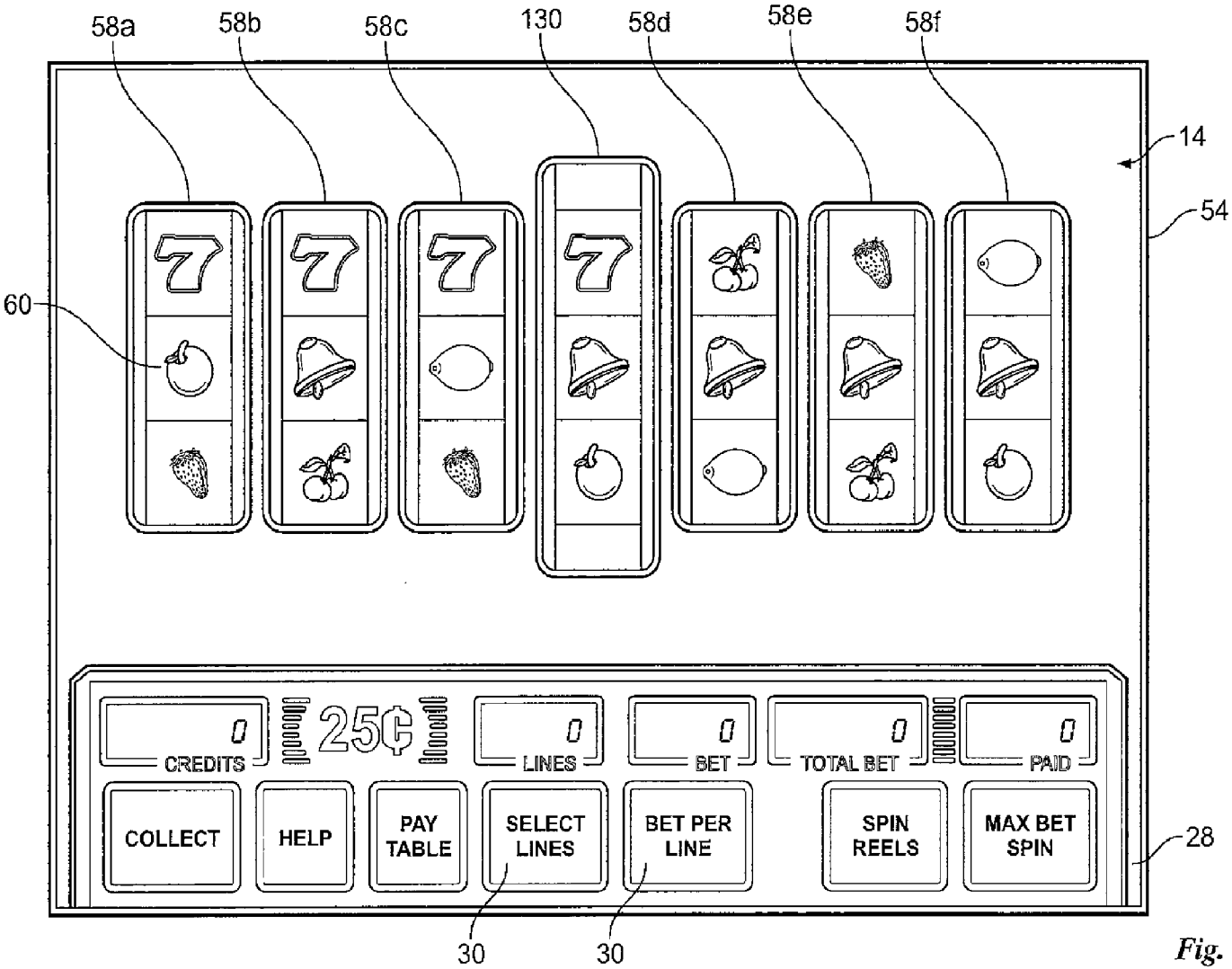

DISPLAYING A COMMON SYMBOL-BEARING REEL. The transmissive display 54 can also provide a single video reel 130 that is commonly used in conjunction with a first set of the mechanical reels 58*a*, 58*b*, 58*c* and a second set of the mechanical reels 58*d*, 58*e*, 58*f*, as shown best in FIG. 6*e*. The video reel 130 can be used as the fourth reel in the first set of the mechanical reels 58*a*, 58*b*, 58*c* as evaluated from left-to-right. The video reel 130 can be also used as the fourth reel in the second set of the mechanical reels 58*d*, 58*e*, 58*f* as evaluated from right-to-left. Or, the video reel 130 can be also used as the first reel with in the second set of the mechanical reels 58*d*, 58*e*, 58*f* as evaluated from left-to-right. The single video reel 130 may simultaneously be involved with multiple wins on the different mechanical reels sets, such as the four SEVENS symbols on the first set of the mechanical reels 58*a*, 58*b*, 58*c* and the four BELL symbols on the second set of the mechanical reels 58*d*, 58*e*, 58*f*.

DISPLAYING GAME-ENHANCEMENT REELS. The transmissive display 54 can provide a reel that depicts symbols that will enhance the underlying award of the basic game, as dictated by the mechanical reels 58*a*, 58*b*, 58*c*. For example, the transmissive display 54 may include a reel that has a variety of multipliers (e.g., 1×, 2×, 5×, 10×). When a certain winning combination is achieved in the basic game, the multiplier reel begins to spin and indicates a certain multiplier that is used to enhance the underlying award of the basic game by the multiplier amount. In addition to multipliers, other game enhancement parameters on the video reel on the transmissive display 54 may include (i) allowing a player to hold one or more reels to enhance the existing award on the next spin (a hold-reels option), (ii) paying credits for certain symbols on the reels, such as scatter symbols, or (iii) adding a WILD symbol to a certain symbol location or a random symbol location on the mechanical reels 58*a*, 58*b*, 58*c*. Other types of triggering events can also be used to cause the activation of the reel containing these game enhancement parameters.

DISPLAYING GAME-ENHANCEMENT ANIMATED CHARACTER. The transmissive display 54 can also illustrate an animated character (e.g., a Penguin) that provides a game enhancement parameter to the basic game. In response to certain conditions, the animated character can provide multipliers or wild symbols (or other game enhancement parameters) that affect the basic game as dictated by the mechanical reels 58*a*, 58*b*, 58*c*. Due to the fact that the animated character is displayed on the transmissive display 54, it can move around the periphery of and over the mechanical reels 58*a*, 58*b*, 58*c* while providing the game enhancement parameters.

HOLD OR RESPIN BUTTONS. The transmissive display 54 can provide hold or respin buttons located above the mechanical reels 58*a*, 58*b*, 58*c*. For example, the transmissive display 54 may include a hold button and a respin button that the player touches to instruct the gaming machine 10 to respin or hold each of the mechanical reels 58*a*, 58*b*, 58*c* under certain situations. The respin feature may be awarded to the player in response to a certain symbol (e.g., scatter symbol) appearing on one or more of the mechanical reels 58*a*, 58*b*, 58*c*, after accumulating certain beneficial symbols during the gaming session, or other predetermined conditions.

AWARDS BASED ON SYMBOL ACCUMULATION IN EACH SPIN. In some games, the accumulation of a certain beneficial symbol within each spin indicates the amount of the award. That award may be a bonus award or a progressive award that is provided to the player in addition to the award for the underlying basic game. The number of beneficial symbols dictates the award level that has been achieved by the player (e.g., 6 beneficial symbols result in the award of a first progressive jackpot, but 7 beneficial symbols result in the award of a second, larger progressive jackpot). The transmissive display 54 can display a medium for providing additional opportunities to increase the number of the beneficial symbols to the player. For example, the transmissive display 54 may include a continuously moving symbol banner above the mechanical reels 58*a*, 58*b*, 58*c* that comes to a stop after the mechanical reels 58*a*, 58*b*, 58*c* stop. Any beneficial symbol on the movable banner can be added to the number of beneficial symbols on the mechanical reels 58*a*, 58*b*, 58*c* to determine the total number of beneficial symbols achieved by the player on that particular spin, which dictates the final award.

ACCELERATE OR DECELERATE FEATURE FOR THE REELS. As mentioned above, the transmissive display 54 may be used in conjunction with the touch screen 28 to allow a player to accelerate or decelerate the movement of one or more of the mechanical reels 58*a*-58*c*. For example, the player may touch a certain area of the touch screen 28 that is shown as a button 30 or lever on the transmissive display 54. The deceleration can be accomplished by movements on the button 30 in a direction that is opposite to the movement of the mechanical reels 58*a*-58*c*. The button 30 may be elongated in the direction of the reels 58*a*-58*c* and include arrows symbols in both directions to permit the player to individually increase or decrease the rate of rotation of a mechanical reels 58*a*-58*c*.

Group 9: Displaying Information

APPLIQUE OVER REGIONS OF THE TRANSMISSIVE DISPLAY. The gaming machine may include a plastic appliqué overlying the transmissive display 54 in regions outside of the mechanical reels 58*a*-58*c*. The appliqué has windows that "frame" certain areas of the transmissive display 54 such that various information can be placed in the windows as dictated by the transmissive display 54. The windows can provide information about the wager, the pay lines, the awards, and other information concerning the basic game. Other windows can provide information regarding services (e.g., sports service, news service) available to the player at the casino. The windows may also provide information such as videos (e.g., music videos) to provide other forms of entertainment. In summary, because the transmissive display 54 provides the ability to display variable information, the overlying appliqué provides a convenient structure for separating and individualizing each type of information that is displayed to the player. It should be apparent to the skilled artisan that the aforementioned information can also be provided by the transmissive display 54 without the use of the appliqué, or with the use of an appliqué that only covers sections of the transmissive display 54.

ALTERING THE IMAGERY AROUND THE REELS. The transmissive display 54 can be used to provide various thematic indicia around the mechanical reels 58*a*-58*c*. The thematic indicia may change based on the status of the basic game, the time the day, or the time of the year. The images may also change based on the outcome of the wagering game. For example, if a winning outcome is achieved, and coins are returned to the player (or simulated) the imagery may simulate a shaking motion corresponding to the movement of the coins. Alternatively, the imagery may shake or move slightly in response to the mechanical reels 58*a*-58*c* moving.

ADDITIONAL VISUAL EFFECTS BASED ON PLAYER INPUT. A player who touches the touch screen 28 may cause random or specific visual effects to occur on the transmissive display 54. For example, if a player slides his or her finger along the transmissive display 54, a trail of simulated phosphorescent sparkles may follow the player's finger. Other touches at certain times of the basic game may cause certain messages to appear. For example, after the player has nearly achieved a large winning outcome, if the player is using other touch buttons on the transmissive display 54 to cause the next spin or change the wager amount, a message may appear, such as "That was REALLY close" Other messages may occur in response to the initiation or termination of a touch, such as various congratulatory statements after a winning combination. Preferably, any of these messages occur at a location associated with the player's contact of the touch screen 28.

PLAYER TRACKING AND TOURNAMENT INFORMATION. As indicated above, the transmissive display 54 may be used in conjunction with the touch screen 28 to facilitate the input and the display of player-tracking information and tournament information. The transmissive display 54 may also be used to display player information, earned points, tournament entry information, tournament status information, and so forth. The use of an appliqué may facilitate the separation of this information into various windows.

HELP OPTIONS AND PAY TABLES. The transmissive display 54 may be used in conjunction with the touch screen 28 to provide help options to the player. The information associated with the help options could be located only around the mechanical reels 58*a*-58*c*. The transmissive display 54 may be used in conjunction with the touch screen 28 to allow a player to touch a location on the transmissive display 54 over a symbol from the underlying mechanical reels 58*a*-58*c* to reveal a pay table associated with that symbol. Alternatively, a pay table button may be located below each one of the mechanical reels 58*a*-58*c* on the transmissive display 54. Each time a player touches the button, one of three symbols displayed on that specific one of mechanical reels 58*a*-58*c* is displayed along with a pop-up window on the transmissive display 54, which has a pay table for all winning combinations that include that symbol.

ADMINISTRATIVE OPTIONS AND PLAYER INPUT. As mentioned in Group 4, the transmissive display 54 may be used to display various administrative options to the casino operators. Furthermore, the transmissive display 54 may be used to display various player inputs, as well other display meters (e.g., credit meters) and/or buttons 30 in locations directly around the mechanical reels 58*a*, 58*b*, 58*c*.

SPORTS BOOK AND SPORTS TICKER. In regions of the transmissive display 54 outside the mechanical reels 58*a*, 58*b*, 58*c*, the player may choose to have sports-related information displayed. This may include the betting odds on various sporting events that will be occurring in the near future. It can also include real-time updates of scores and/or outcomes of sporting events. The player may choose the type of sports information that is displayed on the transmissive display 54. Additionally, the transmissive display 54 may provide inputs via the touch screen 28 that permit the player to make a wager on various sporting events. Other types of informational services can be provided as well, such as a news-related services.

IN-GAME ALTERATIONS OF A WAGER. In regions of the transmissive display 54 outside the mechanical reels 58*a*, 58*b*, 58*c*, a message can be displayed to the player asking if he or she would like to alter the original wager. For example, after the first two mechanical reels 58*a*, 58*b* have come to a stop but while the third mechanical reel 58*c* is still spinning, the transmissive display 54 may provide a question, such as "Would you like to double your bet?" If the player responds "yes", then he or she would have a larger wager on the outcome of the basic game, with only the third mechanical reel 58*c* needing to stop. Such an inquiry may occur only in response to the start of a winning symbol combination appearing on the first two mechanical reels 58*a*, 58*b*. Alternatively, the inquiry may occur randomly at various points within the gaming session.

While a number of exemplary embodiments have been described herein, numerous variations and modifications exist. For example, although the invention has been described with respect to the basic game being played on a mechanical display and the additional features and bonus games implemented via the transmissive display 54, it is possible to play the basic game on the transmissive display 54 instead. Then, when the player achieves a bonus game, the transmissive display 54 may open up to the mechanical display behind the transmissive display 54 to allow the player to play the bonus game. Examples of the types of mechanical display that may be played as a bonus game include the mechanical reels 58*a*-*c*, a mechanical wheel (e.g., a roulette game), mechanical dice, a pachinko board, and various types of board games.

In addition to the above, instead of superimposing the transmissive display 54 over a mechanical display, it is also possible to overlay the transmissive display 54 over a video display. Such a video display may include an LCD, plasmas, projection, or any other suitable video display. The transmissive display 54 may then be used to provide selective visibility of the video display. For example, the transmissive display 54 may display the basic game, then selectively open up to a view of the bonus game on the video display, or vice versa.

Moreover, there may be interaction between the video images of the two displays. For example, the symbols of the transmissive display 54 may engage in a simulated battle with the symbols of the video display, with the outcome determining the payout to the player. Or the symbols of the transmissive display 54 may form combination symbols with the symbols of the video display, and so forth.

While a number of specific embodiments have been described above, variations and modifications exist. For example, two or more of the above features may be combined into single feature, or one feature may be divided into several sub-features. In addition, although the various features described above have been organized into several specific groups, the gaming machine 10 and the wagering game thereon are not limited to any specific group (or feature). Thus, multiple features from several groups may be present on one gaming machine 10. Moreover, while the various features have been organized based primarily on their functions, these features may certainly be reorganized based on another criterion without departing from the scope of the invention.

Accordingly, each of the foregoing embodiments and obvious variations thereof are contemplated as falling within the spirit and scope of the claimed invention, which is set forth in the following claims.

The invention claimed is:

1. A method of conducting a wagering game, comprising:

receiving, from an input device, a wager input from a player for playing the wagering game;

in response to receiving the wager input, displaying symbols on a plurality of movable reels to indicate a randomly selected outcome that is selected from a plurality of outcomes;

while at least some of the reels are moving, activating a transmissive display overlying the plurality of reels to create a moving opaque region;

stopping the movement of the plurality of reels;

stopping the movement of the moving opaque region;

revealing, by use of the transmissive display, an underlying symbol located under the opaque region, the revealing including changing an opacity of the opaque region to cause the opaque region to become transparent so as to reveal the underlying symbol; and in response to the revealed underlying symbol being a predetermined symbol, providing a payout benefit to the player.

2. The method of claim 1, wherein the plurality of reels are mechanical reels.

3. The method of claim 1, wherein a winning symbol combination is indicated along an active payline extending through symbol locations, and the payout benefit is a multiplier value that enhances a payout associated with the winning symbol combination.

4. The method of claim 1, wherein the moving opaque region covers only a single symbol location.

5. The method of claim 1, wherein the moving opaque region moves randomly across the transmissive display.

6. The method of claim 1, wherein the movement of the moving opaque region continues to occur after one of the reels has stopped.

7. The method of claim 1, wherein the plurality of reels are video reels having symbols that move across a video display.

8. The method of claim 1, where the activating the transmissive display creates multiple moving opaque regions and the revealing includes revealing multiple symbols located under the multiple opaque regions.

9. A method of conducting a wagering game, comprising:

receiving, from an input device, a wager input from a player for playing the wagering game;

in response to receiving the wager input, displaying symbols on a plurality of movable reels to indicate a randomly selected outcome that is selected from a plurality of outcomes;

activating a transmissive display overlying the plurality of reels to create an opaque region over a symbol location, the opaque region temporarily blocking out a player's view of a symbol under the opaque region;

in response to a triggering event, revealing, by use of the transmissive display, the symbol located under the opaque region, the revealing including changing the opacity of the opaque region; and in response to the revealed symbol being a predetermined symbol, providing a payout benefit to the player.

10. The method of claim 9, wherein the plurality of reels are mechanical reels.

11. The method of claim 9, wherein the opaque region moves across the transmissive display to hide symbols within different symbol locations.

12. The method of claim 11, wherein the opaque region moves across the transmissive display while at least some of the plurality of moveable reels are moving.

13. The method of claim 12, wherein the activating the transmissive display creates multiple opaque regions that are moving across the transmissive display while the plurality of moveable reels are moving.

14. The method of claim 9, wherein the activating the transmissive display creates multiple opaque regions and the revealing includes revealing multiple symbols located under the multiple opaque regions.

15. The method of claim 9, wherein the plurality of reels are video reels having symbols that move across a video display.

16. The method of claim 9, wherein the opaque region is located over the entirety of one of the plurality of reels and the revealing includes revealing multiple symbols located on the one of the plurality of reels.

17. A method of conducting a wagering game, comprising:

receiving, from an input device, a wager input from a player for playing the wagering game;

in response to receiving the wager input, displaying symbols on a plurality of movable reels to indicate a randomly selected outcome for the wagering game;

activating a transmissive display overlying the plurality of reels to create an opaque region that moves over symbols on the plurality of movable reels, the opaque region blocking a player's view of symbols on the movable reels that are underlying the opaque region;

in response to a triggering event, revealing, by use of the transmissive display, a first symbol located under the opaque region, the first symbol being initially blocked from the player's view by the opaque region and then becoming visible to the player by changing an opacity of the opaque region; and in response to the revealed first symbol being a predetermined symbol, providing a payout benefit to the player.

18. The method of claim 17, wherein the plurality of moveable reels are mechanical reels.

19. The method of claim 17, wherein the opaque region moves across the transmissive display while at least some of the plurality of moveable reels are moving and the opaque region is of a size larger than one of the plurality of symbol locations.

20. The method of claim 17, wherein the activating the transmissive display creates multiple opaque regions that are moving across the transmissive display while the plurality of moveable reels are moving.

* * * * *